US009567724B2

(12) United States Patent
Wagner

(10) Patent No.: US 9,567,724 B2
(45) Date of Patent: Feb. 14, 2017

(54) LIFTING ARRANGEMENT FOR A CONSTRUCTION MACHINE

(71) Applicant: Guangxi LiuGong Machinery Co., Ltd., Liuzhou, Guangxi (CN)

(72) Inventor: Edward Wagner, Guangxi (CN)

(73) Assignee: GUANGXI LIUGONG MACHINERY CO., LTD. (CN)

( * ) Notice: Subject to any disclaimer, the term of this patent is extended or adjusted under 35 U.S.C. 154(b) by 0 days.

(21) Appl. No.: 14/695,334

(22) Filed: Apr. 24, 2015

(65) Prior Publication Data

US 2016/0222624 A1 Aug. 4, 2016

(30) Foreign Application Priority Data

Feb. 2, 2015 (WO) ..... PCT/CN2015/072109

(51) Int. Cl.

| | |
|---|---|
| ***E02F 9/08*** | (2006.01) |
| ***E02F 3/43*** | (2006.01) |
| ***B66F 9/00*** | (2006.01) |
| ***E02F 3/34*** | (2006.01) |
| ***E02F 9/20*** | (2006.01) |
| ***E02F 3/342*** | (2006.01) |

(Continued)

(52) U.S. Cl.

CPC ..... *E02F 3/434* (2013.01); *B66F 9/00* (2013.01); *E02F 3/342* (2013.01); *E02F 3/3405* (2013.01); *E02F 3/38* (2013.01); *E02F 3/422* (2013.01); *E02F 3/431* (2013.01); *E02F 9/0841* (2013.01); *E02F 9/2029* (2013.01)

(58) Field of Classification Search

None

See application file for complete search history.

(56) References Cited

U.S. PATENT DOCUMENTS

| | | | |
|---|---|---|---|
| 2,980,271 | A | 4/1961 | Ulinski |
| 2,982,101 | A | 5/1961 | Hackett et al. |

(Continued)

FOREIGN PATENT DOCUMENTS

| | | | |
|---|---|---|---|
| CN | 1651666 | A | 8/2005 |
| CN | 201050073 | Y | 4/2008 |

(Continued)

OTHER PUBLICATIONS

Notification of Transmittal of The International Search Report and The Written Opinion of Thee International Searching Authority, or the Declaration issued in PCT/CN2015/072109, dated Jul. 23, 2015, 12 pages.

(Continued)

*Primary Examiner* — Thomas Tarcza
*Assistant Examiner* — Garrett Evans
(74) *Attorney, Agent, or Firm* — Greenberg Traurig LLP

(57) ABSTRACT

A lifting arrangement for a construction machine is provided which includes a main arm (3) which is provided with a pivot connector (4). The pivot connector (4) is pivotably supported on a main arm support means (6). The main arm support means (6) is moveable in a direction which includes at least a component in the front-rear direction with respect to a frame arrangement of a construction machine to which the lifting arrangement can be applied. Based on a control of a main arm actuating element (11) and an auxiliary actuating element (21), a path of an equipment connector (5) upon moving said main arm (3) between a lowered position and a lifted position can be achieved which follows a predetermined path.

19 Claims, 32 Drawing Sheets

(51) Int. Cl.
*E02F 3/38* (2006.01)
*E02F 3/42* (2006.01)

(56) References Cited

U.S. PATENT DOCUMENTS

| | | | |
|---|---|---|---|
| 4,235,567 | A | 11/1980 | Pilch |
| 4,405,281 | A | 9/1983 | Ruttershoff |
| 2006/0243234 | A1 | 11/2006 | Shibuya |
| 2012/0293316 | A1 | 11/2012 | Johnson et al. |

FOREIGN PATENT DOCUMENTS

| | | | |
|---|---|---|---|
| CN | 102285327 | A | 12/2011 |
| CN | 203452106 | U | 2/2014 |
| DE | 20220920 | U1 | 7/2004 |
| GB | 2049615 | B | 12/1980 |
| JP | S55140556 | U | 10/1980 |
| JP | S63197726 | A | 8/1988 |
| JP | 2006307498 | A | 11/2006 |

OTHER PUBLICATIONS

Partial European Search Report, Application Serial No. 15162500.1-1712, filed Jun. 6, 2015, by S. Papadimitriou.
International Search Report and the Written Opinion of the International Searching Authority, PCT Application No. PCT/CN2015/072109, filed Jul. 15, 2015, by Shuhua Zheng.

LIFTING ARRANGEMENT FOR A CONSTRUCTION MACHINE

CROSS REFERENCE TO RELATED APPLICATION

This application claims the benefit of PCT/CN2015/072109, filed Feb. 2, 2015 the disclosure of which is incorporated herein in its entirety by reference.

The present invention relates to a lifting arrangement for a construction machine. In particular, the present invention relates to a lifting arrangement which can be advantageously applied to a wheel loader.

TECHNICAL BACKGROUND

Construction machines include those which are used for lifting heavy loads such as in mining or similar operations. Mobile construction machines having a lifting arrangement are known such as wheel loaders or the like. For such applications it is crucial to provide a maximum loading and lifting capacity for the lifting arrangement as this is the main factor affecting the operational efficiency of such construction machines. An operation of construction machines using lifting arrangements includes a loading operation of the material to be lifted at a lower level, a lifting operation for lifting the load to a higher level and an unloading operation e.g. for dumping or unloading the lifted load at the higher level.

In specific applications using a lifting arrangement which is mounted at the front area of mobile construction machines, the lifting capacity is not only limited by the available power driving actuators used for lifting the load. Rather, a weight distribution of such mobile construction machines is a limiting factor restricting the lifting capacity of such lifting arrangements as the mobile construction machine must remain stable in the course of the lifting operation. Consequently, variations of the weight distribution of the mobile construction machines or an increase of the total weight of the machine are considered in order to enhance the lifting capacity of the lifting arrangement. However, such variations in weight distribution or even an increase of the total weight of the mobile construction machine have clearly a negative influence on the drivability and the overall weight of the construction machine. Moreover, drive sources for driving the machine must be designed for such an increased weight of the machine which deteriorates the overall efficiency in view of a specified maximum lifting capacity. The above disadvantages have been accepted previously in order to provide construction machines having the desired lifting capacity.

SUMMARY OF THE INVENTION

It is the object of the present invention, to provide an improved lifting arrangement for a construction machine which enhances the loading and lifting capacity without negatively affecting the overall efficiency of the construction machine.

The object is solved by a lifting arrangement for a construction machine having the features of the independent claims. Further advantageous developments of the invention are defined in the dependent claims.

According to a first aspect of the present invention, a lifting arrangement for a construction machine having a frame arrangement with a front frame portion and a rear frame portion is provided, wherein said lifting arrangement is mountable to said frame arrangement. According to the present aspect of the invention, the lifting arrangement comprises the following:

A main arm which is provided with a pivot connector at a proximate end thereof and an equipment connector at a distal end thereof, a main arm support means for pivotably supporting said pivot connector of said main arm, wherein said main arm support means is movably mounted on said frame arrangement such that said pivot connector of said main arm is movable in a direction which includes at least a component in the front-rear direction which respect to said frame arrangement, a main arm actuating element engaged to said main arm and an auxiliary actuating element engaged to said main arm support means, for moving said equipment connector between a lowered position and a lifted position, determining means for determining a lifting related quantity reflecting a position of said equipment connector with respect to said front frame arrangement, and control means for controlling an operation of said main arm actuating element and said auxiliary actuating element based on the determined lifting related quantity, such that a part of said equipment connector upon moving said main arm between said lowered position and said lifted position follows a predetermined path, preferably a substantially vertical path.

According to the above aspect, the lifting arrangement uses a main arm which is pivotably supported in order to transfer a pivoting movement of said main arm into a lifting movement of said equipment connector. In addition, the main arm support means provides a predetermined movability of the pivot connector of said main arm in order to influence the path along which said equipment connector moves in the course of said lifting operation. Due to the fact that said main arm support means is movably mounted to said frame arrangement, i.e. is movable in a direction which includes at least a component in the front-rear direction with respect to said frame arrangement, a predetermined path along which said equipment connector moves can be achieved. This predetermined path can be a path which deviates from a circular path with a radius which is determined by the distance between the pivot connector and the equipment connector.

As the movement of said main arm support means can be controlled to a predetermined movement pattern in accordance with the lifting operation of said lifting arrangement, a predetermined path can be achieved. Based on the function of the determining means and the control means, the operation of the above mentioned main arm actuating element and auxiliary actuating element can be controlled such that a substantially vertical path is achievable.

According to an embodiment of the invention, said main arm support means is formed as main arm support link having a first bearing portion a second bearing portion, said first bearing portion being pivotably mounted to said pivot connector of said main arm and said second bearing portion being pivotably mounted to said front frame portion. According to this embodiment, the movability of said main arm support means is achieved with simple means such as the above mentioned support link which is mounted to said front frame portion such that said main arm support means extends in an upward direction. With such a construction, the tilting or pivoting movement of said support link provides movability in a direction which includes at least a component in the front-rear direction with respect to said frame arrangement.

According to an embodiment of the invention, said main arm actuating element has a first end and a second end, the first end being pivotably mounted to said main arm at a position between said pivot connector and said equipment connector. The use of such an arrangement provides a simple actuating operation of said main arm in order to provide the required pivoting movement of said main arm in order to achieve the lifting operation of said equipment connector.

According to an embodiment of the invention, said auxiliary actuating element has a first end and a second end, the first end being pivotably mounted to said main arm support means. This arrangement allows a predetermined movement of said main arm support element by operating said auxiliary actuating element. With such an operation, said pivot connector of said main arm is movable in a direction which includes at least a component in the front-rear direction with respect to said frame arrangement.

According to an embodiment of the invention, said second end of said auxiliary actuating element is pivotably mounted to said main arm. As alternative, said second end of said auxiliary actuating element is pivotably mounted to said front frame portion. Based on the above alternatives, the cooperation of said auxiliary actuating element and said main arm actuating element provides the pivoting movement of said main arm in association with a movement of said main arm support means in order to achieve the predetermined pattern of movement of said equipment connector.

According to an embodiment of the invention, said second end of said main arm actuating means is pivotably mounted to said front frame portion. As alternative, said second end of said main arm actuating means is pivotably mounted to said main arm support means. With such an arrangement, the cooperation of said main arm actuating element and said auxiliary actuating element allow the predetermined movement pattern of said equipment connector in the course of a lifting operation.

According to an embodiment of the invention, said support link includes an actuation extension which is mounted to said second bearing portion and extends straight or angled with respect to a longitudinal direction of said support link, said first end of said auxiliary actuating element being pivotably mounted to said actuation extension. With such an arrangement, the construction can be made compact while the required forces from said auxiliary actuating element can be exerted properly to said support link in order to provide the required movement of said support link in the course of a lifting operation.

According to an embodiment of the invention, said determining means includes a first sensing means for determining a rotational position of said main arm with respect to said main arm support means and a second sensing means for determining the position of said main arm support means with respect to said front frame portion, wherein said first and second sensing means preferably include at least one of an angle sensor and a linear sensor. As the lifting arrangement according to the present invention is based on a control system controlling the operations of the respective actuators, the rotation position of said main arm with respect to said main arm support means and of said main arm support means with respect to said front frame portion are obtained in order to provide a proper control operation. Based on such a proper control operation, the predetermined movement pattern of said equipment connector in the course of a lifting operation is achievable. The sensing means are not limited to those which directly sense rotational positions of the tilting or pivoting components. Rather any sensing means for providing position related information of said main arm and said support means which can be transformed into the required information can be used.

According to an embodiment of the invention, at least one linear sensor is mounted to said main arm actuating element and/or to said auxiliary actuating element for determining a respective extension position thereof. As the tilting or rotation action of the respective tilting or rotating elements of the lifting arrangement is associated with the extension length of the respective actuators in case that linear actuators are used, linear sensors are useful for obtaining the respective information. In particular, the linear sensors can be preferably integrated to said linear actuators such that the arrangement can be provided which is compact and simple in construction.

According to an embodiment of the invention, said control means is equipped with a storage means storing a pattern defining a unique relationship between an actuating position of said main arm actuating element and an actuating position of said support means actuating element, wherein the control performed by said control means is based on said pattern. The pattern is not limited to a specific pattern. Rather, the pattern is selected such that the cooperation of movements of the respective actuating elements is predetermined such that the desired path along which the equipment connector follows in the course of a lifting operation can be achieved. Preferably, the pattern used by the control means is such that the path along which the equipment connector moves, is substantially a vertical path.

It is noted that the substantially vertical path is not limited to a strict vertical line with respect to the horizontal direction or the longitudinal direction of the construction machine, but rather a specific range is allowed in which said equipment connector moves in the course of a lifting operation, wherein said range is aligned to the vertical direction and the width of the range extends in the longitudinal direction of said construction machine.

According to the invention, it is possible to achieve a path along which the equipment connector moves upon a lifting operation which deviates from a circular path with a radius which is determined by the distance between the pivot connector and the equipment connector of said main arm. The main purpose of the lifting arrangement according to the invention is to provide a movement path of said equipment connector which provides a decreased protruding distance in the intermediate position of said equipment connector which is positioned between the lowered position and the lifted position of said equipment connector. Based on this concept, the tilting moment exerted by the load acting on said equipment connector can be reduced when compared to the tilting moment acting on a construction machine having a main arm which provides a movement path for the equipment connector along a circular path with a radius which is defined by the distance between the pivot connector and the equipment connector.

It is noted that the pattern stored in said storage means can be replaced or changed automatically or by manipulation by the operator in order to provide a variety of movement patterns of said equipment connector in the course of a lifting operation.

According to an embodiment of the invention, said relationship is such that a movement of said equipment connector follows a predetermined path upon lifting said equipment connector between said lowered position and said lifted position.

According to an embodiment of the invention, at least one of a bucket and a lifting fork for lifting heavy loads is mounted, preferably tiltably mounted to said equipment connector. A bucket can be used to load, lift and unload bulky matters such as in mining or the like. The lifting fork for lifting heavy loads can be used to lift large single piece loads. Both can be understood as equipment to be mounted at the equipment connector. Preferably, the equipment mountable to said equipment connector is arranged with the option of tilting the equipment. The above mentioned bucket or lifting fork are not limiting the invention. Rather, any equipment can be mounted to the equipment connector with or without tilting option as long as a lifting operation is involved.

According to a second aspect of the present invention, a wheel load is provided which has an articulating frame arrangement consisting of a front frame portion and a rear frame portion which are articulatingly interconnected for providing an articulating steering, comprising a lifting arrangement according to one of the above mentioned embodiments.

As discussed above, the lifting arrangement can be constructed as compact structure while the advantage of providing the specified path of the equipment connector can be achieved. When applied to a wheel loader, such a compact arrangement is particularly advantageous due to the fact that an articulating steering is provided between a front frame portion and a rear frame portion.

Accordingly, it is a specific advantage of this aspect of the present invention, that elements forming said lifting arrangement are supported by said front frame portion or said articulating frame arrangement and are articulated together with said front frame portion with respect to said rear frame portion upon steering actions.

In this case, the equipment connected to the equipment connector is preferably provided in front of the front frame portion, wherein the elements of said lifting arrangement are supported by said front frame portion. As the front frame portion in an articulating frame arrangement substantially follows the direction of the front wheels, the operation of the wheel loader following this concept can be operated without any surprising changes in the behavior compared to a standard wheel loader. However, it is also possible to provide a part of the elements forming the lifting arrangement at the rear frame portion. Also, it is possible to provide all elements of the lifting arrangement at the rear frame portion depending on the specific needs.

According to a third aspect of the present invention, a lifting arrangement for a construction machine is provided, the construction machine having a frame arrangement with a front frame portion and a rear frame portion, said lifting arrangement being mountable to said frame arrangement. According to the present aspect of the invention, the lifting arrangement comprises the following:

a main arm which is provided with a pivot connector at a proximate end thereof and an equipment connector at a distal end thereof, a main arm support means for pivotably supporting said pivot connector of said main arm, a main arm actuating element engaged to said main arm for moving said equipment connector between a lowered position and a lifted position, and an auxiliary actuating element which is mounted to said main arm and engaged to said equipment connector for moving said equipment connector in a direction which includes at least a component in the front-rear direction with respect to said frame arrangement, determining means for determining a lifting related quantity reflecting a position of said equipment connector with respect to said front frame arrangement, and control means for controlling an operation of said main arm actuating element and said auxiliary actuating element based on the determined lifting related quantity, such that a path of said equipment connector upon moving said main arm between said lowered position and said lifted position follows a predetermined path, preferably a substantially vertical path.

According to the above aspect, the tilting movement of said main arm provides a lifting operation wherein the position of the equipment connector with respect to said main arm can be controlled by operating said auxiliary actuating element. In this context, the auxiliary actuating element is mounted to said main arm and arranged for changing the position of the equipment connector with respect to said main arm. Preferably, said auxiliary actuating element is formed as linear actuator which is substantially aligned to the longitudinal direction of said main arm. Consequently, the distance between said pivot connector of said main arm and said equipment connector can be controlled by actuating said auxiliary actuating element. As consequence, a cooperating control of said auxiliary actuating element and said main arm actuating element in association with said control means provides a path along which said equipment connector moves which deviates from a circular path having a constant radius. The use of a specific pattern for controlling said auxiliary actuating element and said main arm actuating element in the course of the movement of the equipment connector between a lowered position and a lifted position allows that a predetermined path is achieved. In particular, a specified pattern can be used which provides a path along which the equipment connector follows which is preferably a substantially vertical path as discussed above with respect to the previous aspects of the invention.

It is noted that the above mentioned embodiments can be applied to the third aspect of the invention and provide the same or similar effects and advantages as discussed above. In particular, the application of the third aspect of the invention to a wheel loader having an articulating frame arrangement as defined in the second aspect is also covered by the invention.

Nevertheless, it is explicitly noted that the application of the lifting arrangement is not limited to wheel loaders having an articulating frame arrangement. Due to the compact structure of the inventive lifting arrangement with respect to the above aspects and embodiments, the application to any construction machine provides the same advantage as discussed above.

BRIEF DESCRIPTION OF THE DRAWINGS

The invention is explained based on the enclosed drawings showing an exemplary construction machine equipped with a lifting arrangement according to various embodiments and modifications. It is noted that the following drawings should not be considered as limiting the invention set out in the claims. Moreover, the illustrated construction machine is merely an example and the lifting arrangement according to the invention is applicable to various types of construction machines.

DETAILED DESCRIPTION OF THE EMBODIMENTS

In the following, embodiments and modifications of the present invention are explained in detail based on the drawings. It is noted that the below discussed embodiments can be combined with each other and the invention is not specifically restricted to the structure and arrangement of the specific embodiments and modifications discussed below.

General Overview

The present invention relates to a lifting arrangement which is applicable to construction machines in general. In the following embodiments, the lifting arrangement is illustrated and explained as structure of a construction machine which is embodied as wheel loader. However, the specific application of the lifting arrangement according to the present invention is not limited to the application to a wheel loader. Rather, the lifting arrangement according to the present invention can be applied to a drivable construction machine of any type such as loaders having wheels or crawler track chains or even a combination of both. Moreover, the steering type is not limited to the below discussed optional articulating steering arrangement. Rather, the lifting arrangement is applicable to construction machines having any type of steering arrangements such as articulating steering arrangements, skid steering arrangements or any other type.

Figure 1:
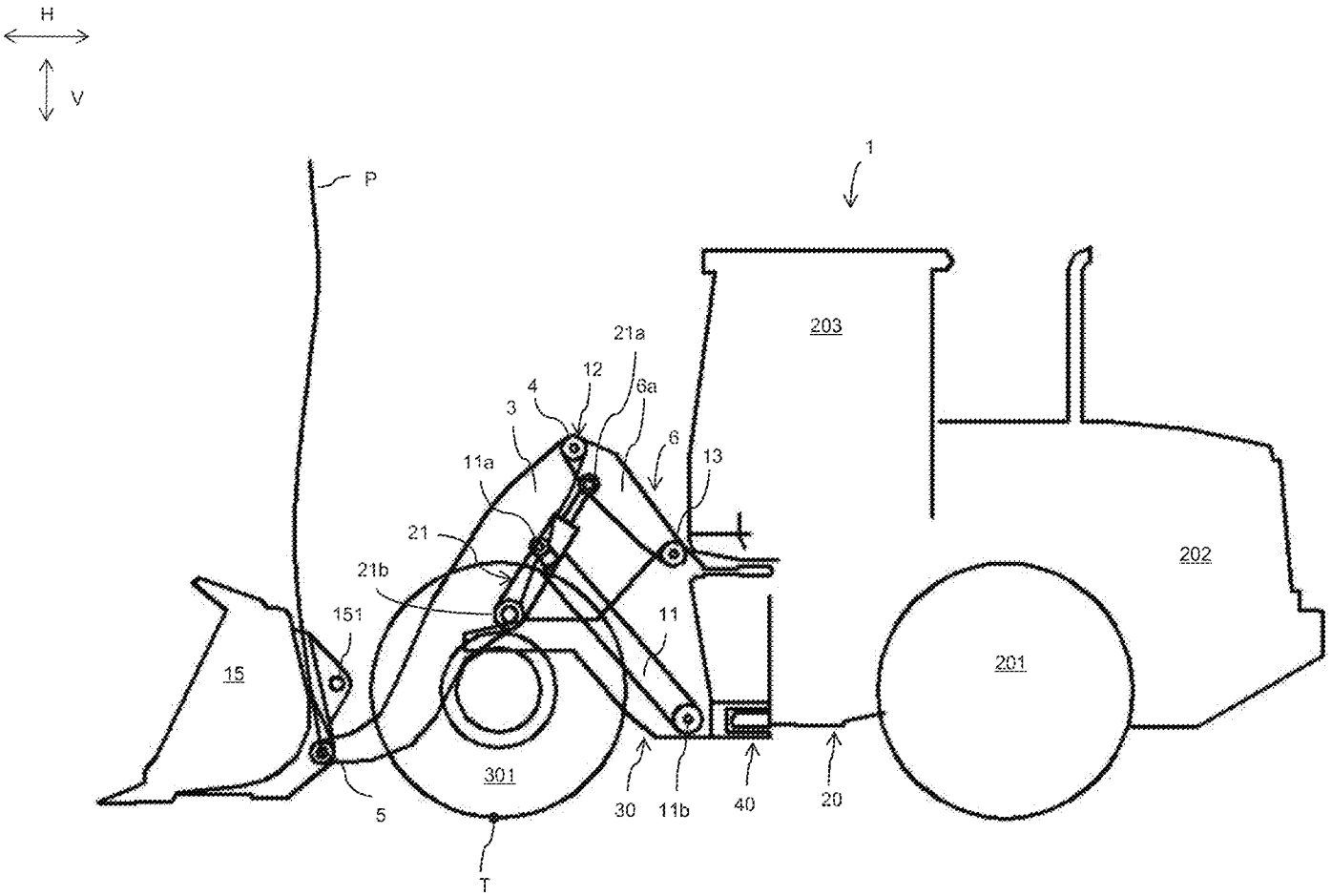
FIG. 1 illustrates a construction machine equipped with a lifting arrangement according to a first embodiment in a lowered position.

The construction machine to which the lifting arrangement according to the present invention is applicable is briefly explained based on the illustration of FIG. 1. FIG. 1 shows the construction machine 1 in a simplified side view. Elements which are not essential for the invention are omitted.

The construction machine 1 comprises a front frame portion 30 and a rear frame portion 20. In the example according to FIG. 1, a pair of front wheels 301 is mounted to the front frame portion 30 and a pair of rear wheel 201 is mounted to the rear frame portion 20. The front frame portion 30 is mounted to the rear frame portion 20 with an articulating steering arrangement 40. The articulating steering arrangement 40 is well known to the skilled person and comprises one ore multiple bearings for providing an articulating mount between the front frame portion 30 and the rear frame portion 20 with a pivoting axis being arranged substantially along the vertical axis of the construction machine 1, e.g. perpendicular with respect to the longitudinal direction of the construction machine 1. The articulating steering arrangement 40 provides a tilting between the front frame portion 30 and the rear frame portion 20 in order to provide a steering by changing the angle enclosed between the rotation axis of the front wheels 301 and the rotation axis of the rear wheels 201. The articulating steering arrangement 40 can be driven by a not illustrated actuator, such as a hydraulic actuator. The type and structure of the articulating steering arrangement 40 is not essential to the invention and can be adapted as required.

The construction machine 1 according to the example shown in FIG. 1 comprises an operator's cab 203 which is mounted to the rear frame portion 20. Inside the operator's cab 203, space for the operator is provided and the required operating and control elements which are not illustrated are accessible by the operator. The operator's cab 203 comprises not illustrated windows in order to provide visibility of the surrounding field for the operator.

An engine compartment 202 is provided at the rear frame portion 20 which houses 1 are multiple power sources for providing power required to operate the construction machine 1. The power sources can include but are not limited to an internal combustion engine, such as a diesel engine, which can be coupled to further equipment such as hydraulic pumps, generators and the like. The power source is used to provide power for driving the front wheels 301 and/or the rear wheels 201 as well as for providing power for actuators besides other elements of the construction machine.

The front frame portion 30 extends in the forward direction with respect to the rear frame portion 20. In the present example, the front frame portion 30 is located in front of the operator's cap 203 and the engine compartment 202. However, the application of the lifting arrangement according to the present invention is not limited to the construction machine 1 having such an arrangement.

Upon a steering operation, the front frame portion 30 tilts with respect to the rear frame portion 20, the operator's cab 203 and the engine compartment 202. However, it is also possible to provide a modified steering arrangement such as a single wheel steering, front wheel steering or rear wheel steering while the articulating steering arrangement is omitted or provided only as option.

In the following, the lifting arrangement according to the present invention is explained in various embodiments, wherein the lifting arrangement is mounted to the front frame portion 30 of the above explained exemplary construction machine 1 embodied as wheel loader.

First Embodiment

The lifting arrangement according to the first embodiment comprises a main arm 3 having a pivot connector 4 at a proximate end and an equipment connector 5 at a distal end thereof. The pivot connector 4 is pivotally supported at a main arm support means 6 which includes a main arm support link 6*a* in the present embodiment. However, the main arm support means is not limited to a link as shown in the drawings. Rather, any support means can be used as long as the pivot connector 4 of the main arm 3 is movable in the required direction as set out below. For example, a slide or guide element can be provided which forms the mains arm support means according to the present invention.

The main arm support link 6*a* has a first end 12 and a second end 13, the first end being pivotally connected to the pivot connector 4 of the main arm 3 and the second end 13 being pivotally connected to an element of the front frame portion 30. The connection between the pivot connector 4 of the main arm 3 and the first end 12 of the main arm support link 6*a* can be provided as bearing arrangement of a suitable type in order to provide e.g. a sliding rotation of the main arm 3 with respect to the main arm support link 6*a*.

The main arm support link 6*a* is pivotally mounted to the front frame portion 30 at its second end 13. In order to provide such a pivotable mount of the main arm support link 6*a* to the front frame portion 30, a rotating bearing of a suitable type is arranged for providing the pivotable movement of the main arm support link 6*a* with respect to the front frame portion 30.

The main arm support means 6 according to the invention is arranged such that a movement of the main arm support means 6 provides a movement of the pivot connector 4 in a direction which at least includes a component in the front-rear direction of the construction machine 1. For this reason, the main arm support link 6*a* is directed in an upward direction with a specific inclination from the vertical direction in the situation in FIG. 1 and provided with a pivoting mount to the front frame portion 30.

A main arm actuating element 11 embodied as linear actuator in FIG. 1 is provided in the lifting arrangement. The main arm actuating element has a second end 11*b* which is pivotably mounted to the front frame portion 30 and a first end 11*a* which is pivotably mounted to the main arm 3. The main arm actuating element is embodied as linear actuator such as a hydraulic actuator in the present embodiment but not limited thereto.

An auxiliary actuating element 21 embodied as linear actuator is provided in the lifting arrangement. The auxiliary actuating element 21 has a first end 21*a* and second end 21*b*, the first end 21*a* being pivotably mounted to said main arm support link 6*a* in the embodiment shown in FIG. 1. The second end 21*b* of the auxiliary actuating element 21 is pivotably mounted to said main arm 3. Accordingly, the auxiliary actuating element 21 operates in order to vary the angle of inclination between the main arm support link 6*a* and the main arm 3. In other words, by extending the auxiliary actuating element 21, the angle enclosed by the main arm support link 6*a* and the main arm 3 is increased.

By actuating the main arm actuating element 11, the main arm 3 is rotated about a pivot center provided at the second bearing portion 13 of said main arm support link 6*a*. In other words, by extending the main arm actuating element 21, the main arm 3 is rotated together with the main arm support link 6*a* in the clockwise direction such that a lifting operation is achieved.

Control System

Figure 31:
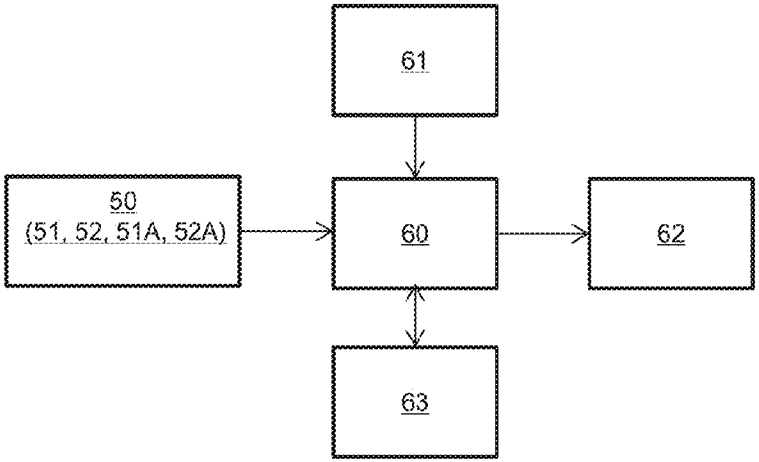
FIG. 31 illustrates components of the control system applied to the lifting arrangement according to the embodiments.

Reference is made to FIG. 31 which discloses the elements of the control system used for the lifting arrangement according to the present invention. The shown control system is only an example and elements which are not essential for the invention are not shown in this illustration. The control system shown in FIG. 31 is mounted in the construction machine at a suitable position. The basic element of the control system is a control means 60 which includes a CPU for performing control operations and other calculations which are required for operating the control system. Information can be obtained from a determining means 50 for determining a lifted related quantity reflecting a position of said equipment connector 5 with respect to the front frame arrangement 30. The determining means 50 can include sensors 51, 52, 51A, 52A. The sensors can be embodied as linear sensors 51, 52 which provide information on the extension position of the linear actuators used for the main arm actuating element 11 and the auxiliary actuating element 21. Such sensors are well known to the skilled person and will be suitably selected from available types. As alternative, rotation sensors can be mounted to those elements of the lifting arrangement which experience a relative rotation between two elements, such as at the connection between the pivot connector 4 of the main arm 3 and the first bearing portion 12 of the main arm support link 6*a* or at the bearing portion supporting the second bearing porting 13 of the main arm support link 6*a* on the front frame portion 30. The type of sensors can be selected as needed as long as it is possible to provide information on the relative position of the main arm with respect to the main arm support link 6*a* as well as the relative position of the main arm support link 6*a* with respect to the front frame portion 30. The determining means 50 using the above mentioned sensors transmits electric signals to the control means 60 which are further processed by the CPU as follows.

The CPU of the control means 60 communicates with a storage means 63 and is capable of obtaining information from the storage means and of transferring information to the storage means 63. The storage means 63 includes besides others information in the form of a set of data, such as functions or patterns.

Furthermore, an input section 61 communicates with the control means 60. The input section 61 is capable of transferring signals to the control means 60 which are e.g. triggered by the operator operating the construction machine. As alternative or in addition, the input section 61 can further communicate with additional control systems in order to provide an automatic trigger for transferring signals to the control means 60.

The control means 60 communicates with an output section 63 which is provided for controlling the actuating system of the lifting arrangement, in particular, the main arm actuating element 11 and the auxiliary actuating element 21. The output section 63 can be combined with a not illustrated solenoid section controlling pressures and/or flow rates of hydraulic fluid to and from the pressure chambers of the actuators in a known manner. Consequently, the output section 62 can transfer the signals provided from the control means 60 into actuating movements of the main arm actuating element 11 and the auxiliary actuating element 21.

The above indicated functions or patterns included in the storage means 63 is used for controlling the movement pattern of the equipment connector 5 of the lifting arrangement in the course of a lifting operation. According to the present invention, the control system provides a relationship between the movement of the main arm actuating element 11 and the movement of the auxiliary actuating element 21. In other words, the function or pattern included in the storage means 63 includes a relationship between the operating position of the main arm actuating element and the operating position of the auxiliary actuating element 21. The relationship can be continuous.

Operation

The operation of the control based lifting arrangement is explained in the following. Starting out from the situation in FIG. 1, the operator manipulates a not illustrated operating element which is associated with the input section 61 in order to initiate a lifting operation for lifting the equipment connector 5 from the lowered position shown in FIG. 1 to a lifted position shown in FIG. 3 through an intermediate position shown in FIG. 2. With the lifting arrangement shown in FIG. 1, the main arm actuating element 11 is extended in order to rotate the main arm 3 together with the main arm support link 6*a* in the clockwise direction in the drawing. In the course of the operation of the main arm actuating element 11, the auxiliary actuating element 21 is retracted as can be derived from a comparison of FIG. 1 with FIG. 2. Based on this retraction of the auxiliary actuating element 21, the angle enclosed between the main arm 3 and the main arm support link 6*a* is decreased and the pivot connector 4 is withdrawn in the rearward direction with respect to the frame arrangement.

Figure 2:
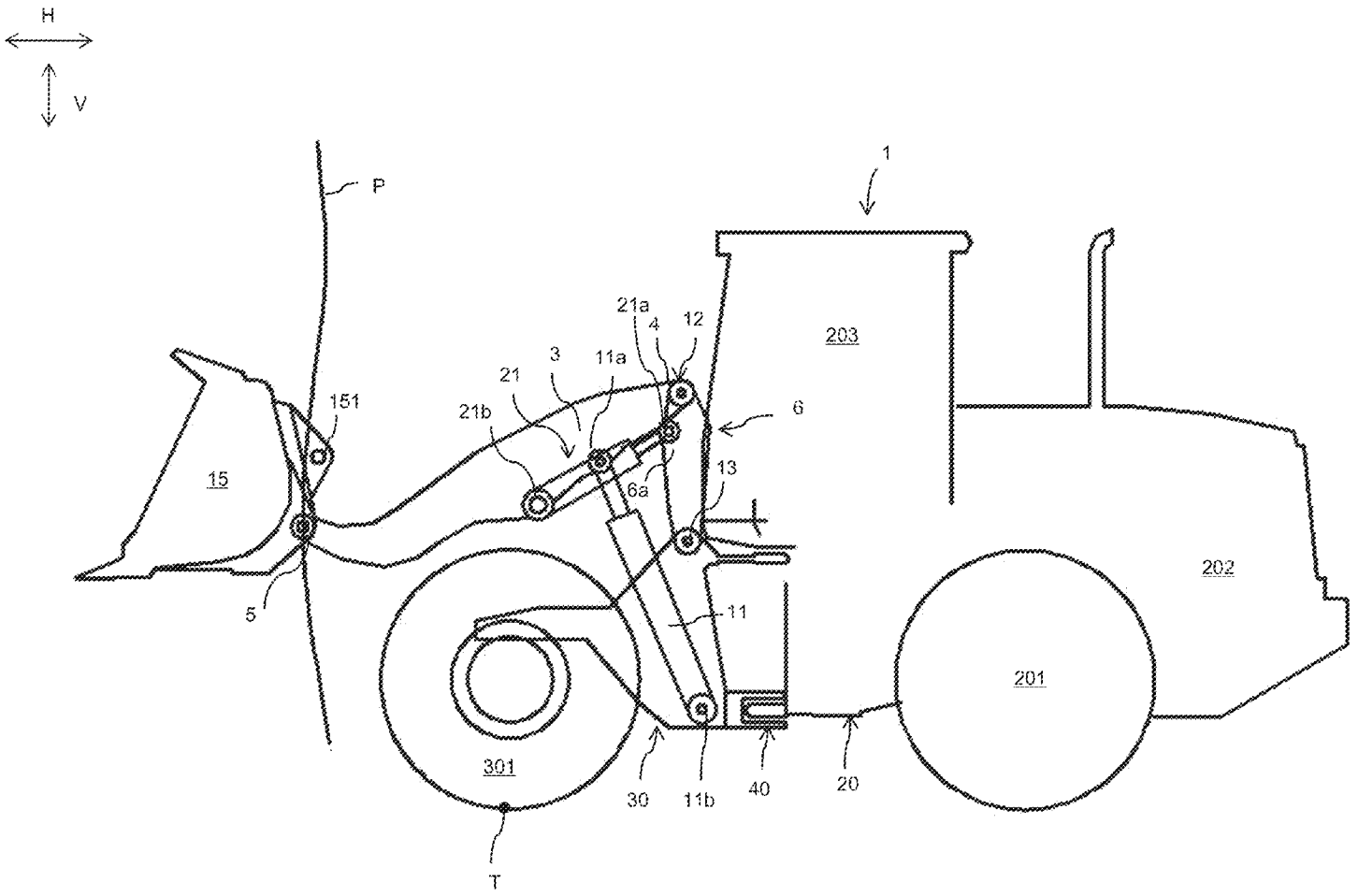
FIG. 2 illustrates a construction machine equipped with the lifting arrangement according to the first embodiment in an intermediate position.

Upon further performing the lifting operation from the intermediate position shown in FIG. 2, the main arm actuating element 11 is further extended in order to further rotate the main arm 3 in the clockwise direction in the drawing. In the course of the lifting operation between the intermediate position shown in FIG. 2 towards the lifted position shown in FIG. 3, the auxiliary actuating element 21 is again extended in order to increase the angle enclosed between the main arm 3 and the main arm support link 6*a*. By this, the pivot connector 4 moved in the forward direction with respect to the frame arrangement.

Based on the above cooperation of the main arm actuating element 11 and the auxiliary actuating element 21 in combination with the construction using the main arm support link 6*a*, a movement pattern of the equipment connector 5 can be provided which deviates from a circular path having a constant radius.

Figure 3:
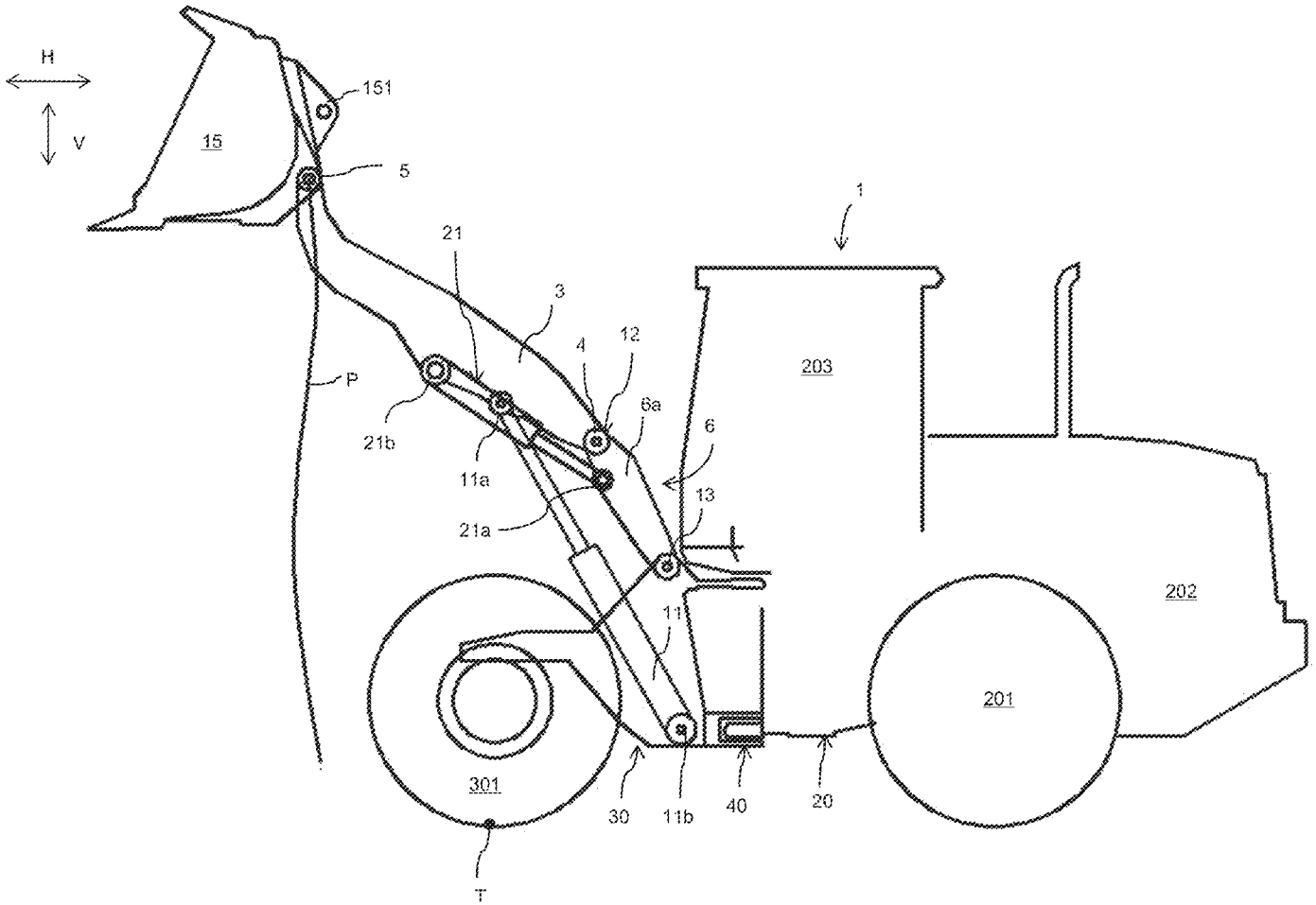
FIG. 3 illustrates a construction machine equipped with the lifting arrangement according to the first embodiment in a lifted position.

The above explained resulting movement pattern which can be derived from FIGS. 1-3, is achieved by using a closed loop control with signals from the sensors as input and signals from the output section 62 as output. Starting again out from the situation in FIG. 1, the determining means 50 using the sensors continuously determines the extension positions of the main arm actuating element 11 and the auxiliary actuating element 21 under the precondition that linear sensors are used. By initiating the lifting operation, the sensor determining the extension position of the main arm actuating element 11 senses a predetermined extension and transmits this as a signal to the control means 60. The control means uses this signal and compares the obtained signal continuously with a selected function or pattern present the storage means. The function can be provided as a continuous function defining the relationship between the extension position of the main arm actuating element 11 and the extension position of the auxiliary actuating element 21 such that this comparison will result in a unique output of a target extension position of the auxiliary actuating element 21. The output section 62 will control the solenoid section in order to set the auxiliary actuating element 21 to the position which corresponds to the target position obtained from the pattern in the storage means.

Figure 32:
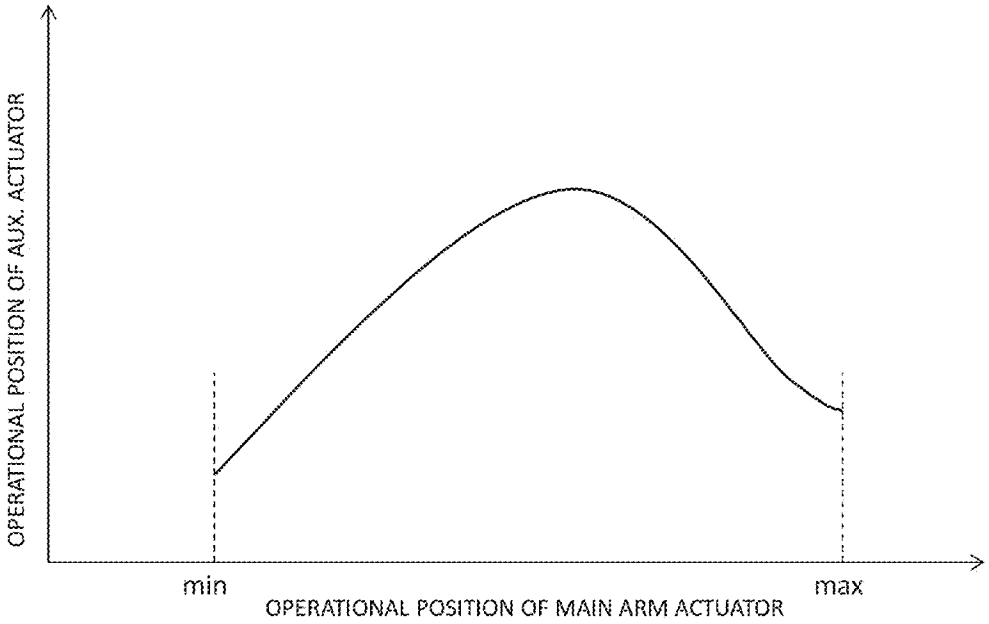
FIG. 32 illustrates an exemplary function which is used in the control of the lifting arrangement according to the invention.

An exemplary function which is used in the control operation of the lifting arrangement according to the invention is illustrated in FIG. 32. The function shown in FIG. 32 is only an example and the design of this function can e.g. be applied to the lifting arrangements shown in FIGS. 7-9. The functions will of course be adapted to the specific geometry of lifting arrangements illustrated in the remaining embodiments and modifications. It is noted that the design of the function is specific for the respective construction of lifting arrangements in that a predetermined path, preferably a substantially vertical path can be achieved along which the equipment connector follows upon a movement between the lowered position and the lifted position thereof.

The above mentioned closed loop control is continuously performed by the control system such that there is always a unique relationship between the extension position of the main arm actuating element 11 and the extension position of the auxiliary actuation element 21. According to the present invention, as stated above, the pattern or function can be set such that the movement pattern of the equipment connector can be predetermined in various ways. According to the most preferable solution according to the present invention, the pattern can be set such that the movement path of the equipment connector 5 follows a substantially vertical path or at least remains within a specific range which is aligned to a vertical direction.

Based on the above operation, the bucket 15 shown as example in FIG. 1 can be moved from the lowered position shown in FIG. 1 to the lifted position shown in FIG. 3 through the intermediate position shown in FIG. 2. Based on the control system and arrangement, the movement of the equipment connector 5 is controlled by the control system along a predetermined movement path which is shown as path P in the drawings. In the present illustration, the path P has an S-shape but basically follows a vertical path throughout the movement of the equipment connector from the lowered position to the lifted position. In particular, the path P deviates from a circular path which is achievable with prior art lifting arrangements in which the pivot connector 4 of the main arm 3 is immovably and stationary with respect to a frame portion of the construction machine 1 and the equipment connector 5 is stationary with respect to the main arm 3. According to the present invention, the movement of the pivot connector 4 of the main arm is achieved by providing the moveable main arm support means 6 and the auxiliary actuating element 21 in addition to the above discussed control system such that the main arm 3 is moved with a specified movement pattern such that a basically vertical movement range of the equipment connector 5 is achievable.

In the following, the advantages of the present invention are explained based on the above embodiment. The lifting capacity of construction machines of this type is crucial for the operational efficiency of the machine. In case the construction machine is supposed to be operated for lifting high loads from the lowered position of the bucket to the lifted position of the bucket, the tilting moment exerted by the load to the construction machine 1 must be considered. In this concept, the point of contact of the front wheels 301 must be considered as tilting point T of the construction machine which is indicated in FIGS. 1-3 at one of the front wheels 301. As the bucket protrudes from the tilting point T in the forward direction, a tilting moment in the counterclockwise direction in FIG. 1 is exerted to the construction machine. As countermeasure, the weight distribution of the construction machine, in particular at the rear side thereof, must be appropriately determined.

Considering a prior art lifting arrangement, upon lifting a load based on a main arm having an equipment connector which follows a circular path upon a movement between a lowered position and the lifted position, the protruding distance of the equipment connector and the load acting on the equipment connector protrudes further in the intermediate position than in the lowered position or the lifted position. According to the present invention, the protruding distance in the horizontal direction between the tilting point T defined as point of contact of the front wheel 301 on the ground and the equipment connector is decreased, in particular in the intermediate position, compared to the known arrangement in which the equipment connector 5 follows a circular path.

Based on the inventive lifting arrangement, the load capacity of the construction machine 1 can be increased due to the fact the tilting moment in the intermediate position of the equipment connector to the construction machine is decreased. On the other hand the construction machine can be downsized while maintaining the same load capacity by using the inventive concept discussed above. The path P shown in the drawings is only an example in order to illustrate that the path P deviates from a circular path which is achieved by prior art lifting arrangements. Depending on the detailed setting of the control system and the mechanical arrangement, e.g. the setup of distances and length of the links, the shape of the path P can be influenced appropriately, in particular based on the pattern or function stored in the storage means. In the context of the present invention, the path P can be considered as vertical path as it deviates from the circular path and is close to a vertical line. It is sufficient in the context of the present invention that the path P remains within a predetermined range of distance between the tilting point T defined by the point of contact of the front wheels 301 with the ground and the vertical distance to the path P.

A further advantage of the above discussed lifting arrangement shown in FIGS. 1-3 is that the structure is based on a control system which uses a control means, inputs from sensors and predetermined patterns stored in a storage means. As the pattern stored in the storage means 63 and used for operating the closed loop control can be appropriately adapted to the needs, the system is flexible and can be operated as vertical lift system or as radial lift arrangement depending on the activated or selected pattern or functions kept in the storage means 63. In other words, it is possible to provide a plurality of patterns or functions in the storage means 63 which allow different movement patterns of the equipment connector upon a lifting movement and selecting one of the patterns or functions which is activated and selected in the current control mode.

In addition, due to the specific arrangement using the actuators and the main arm support means 6, a very compact arrangement is achievable which does not require the provision of elements of the lifting arrangement at the rear section of the construction machine. As such, this simple lifting arrangement is well applicable to wheel loaders using an articulating steering system which provide only a limited space at the front frame portion for mounting the lifting arrangements.

Further Embodiments

In the following, further embodiments of the present invention are explained based on the drawings. It is noted the variations of the following further embodiments can be combined with each other as long as the basic concept set out in the claims is achieved. Moreover, the control system explained above for the first embodiment is applicable to each of the following embodiments in the same way. Therefore, the discussion of the control function as well as the advantages thereof is omitted.

Figure 4:
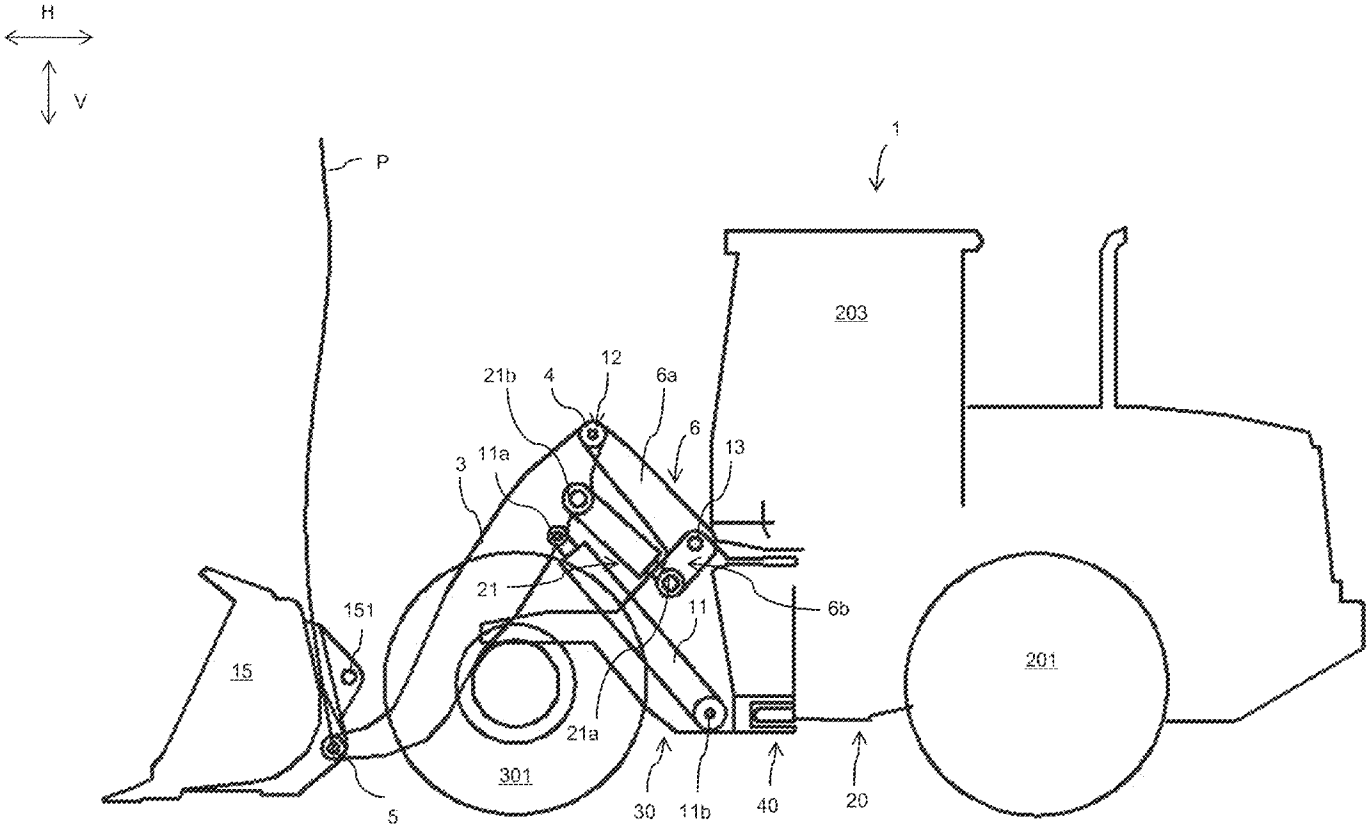
FIG. 4 illustrates a construction machine equipped with a lifting arrangement according to a second embodiment in a lowered position.
Figure 5:
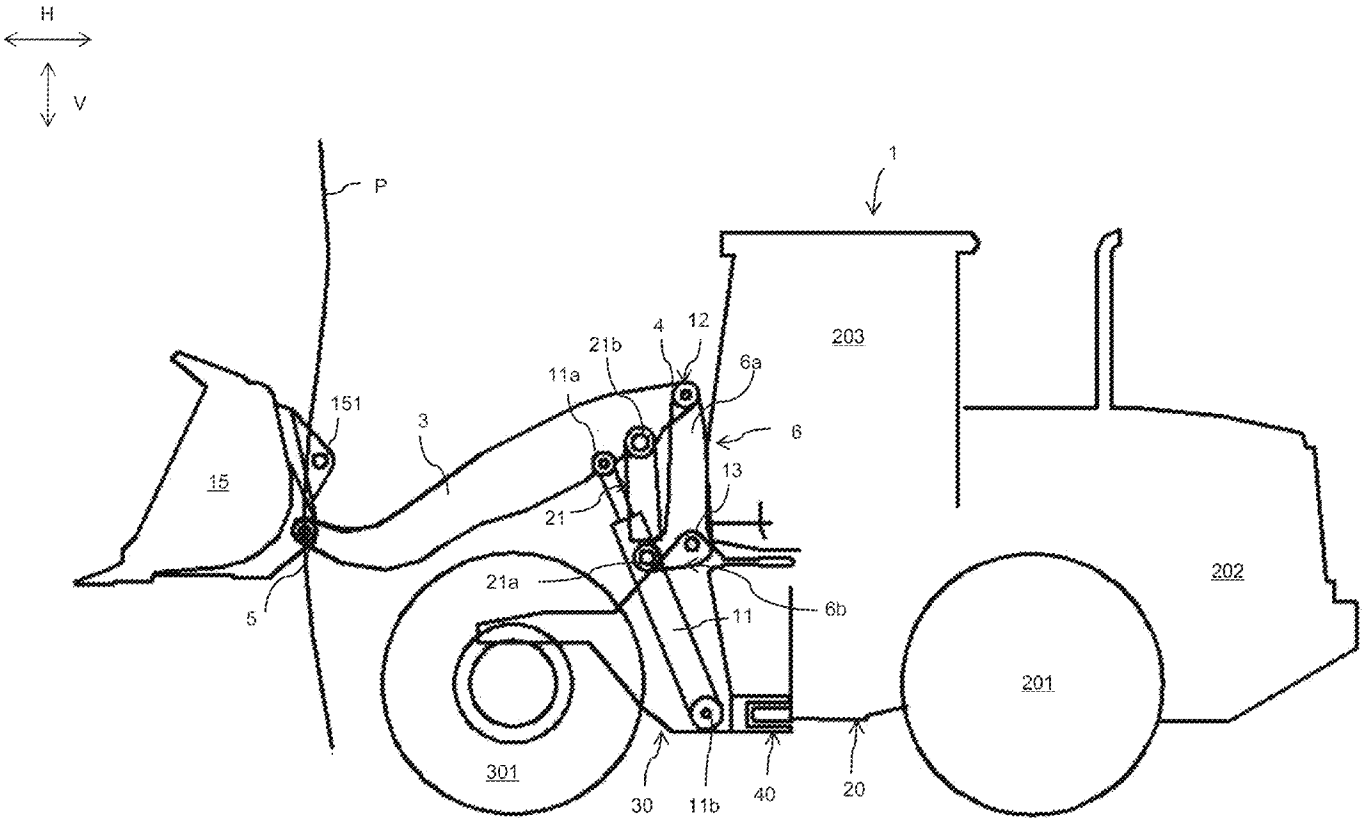
FIG. 5 illustrates a construction machine equipped with the lifting arrangement according to the second embodiment in an intermediate position.
Figure 6:
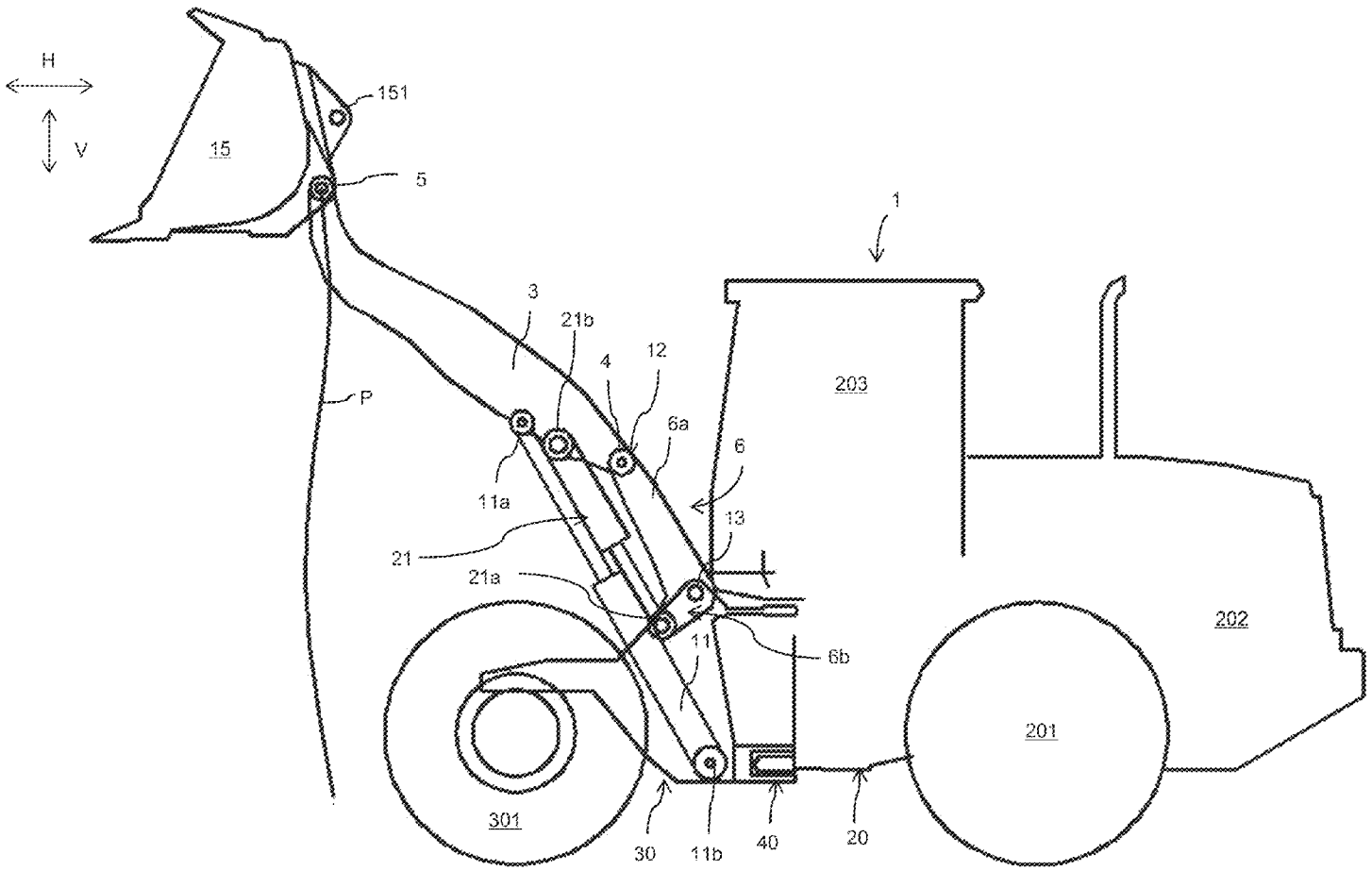
FIG. 6 illustrates a construction machine equipped with the lifting arrangement according to the second embodiment in a lifted position.

FIGS. 4-6 show a second embodiment of the present invention. The present embodiment differs from the first embodiment in that the auxiliary actuating element 21 is arranged in a different position. While the second end **21*b* of the auxiliary actuating element 21 is pivotably mounted to the main arm 3 as in the first embodiment, the first end 21*a* thereof is pivotably attached to an actuation extension 6*b* mounted to the main arm support link 6*a*. The actuation extension 6*b* is mounted to the main arm support link 6*a* on the opposite side to which the main arm support link 6*a*** extends from the second bearing portion thereof. Moreover, the actuation extension 6*b* is mounted to the main arm support link 6*a* in a tilted manner, e.g. tilted towards the main arm 3, as can be derived from FIG. 4. In addition, the second end 21*b* of the auxiliary actuating element 21 is pivotably attached to the main arm 3 at a position between the pivot connector 4 of the main arm 1 and the location where the first end 11*a* of the main arm actuating element 11 is attached. The remaining arrangement and functions are the same as in the first embodiment.

Figure 7:
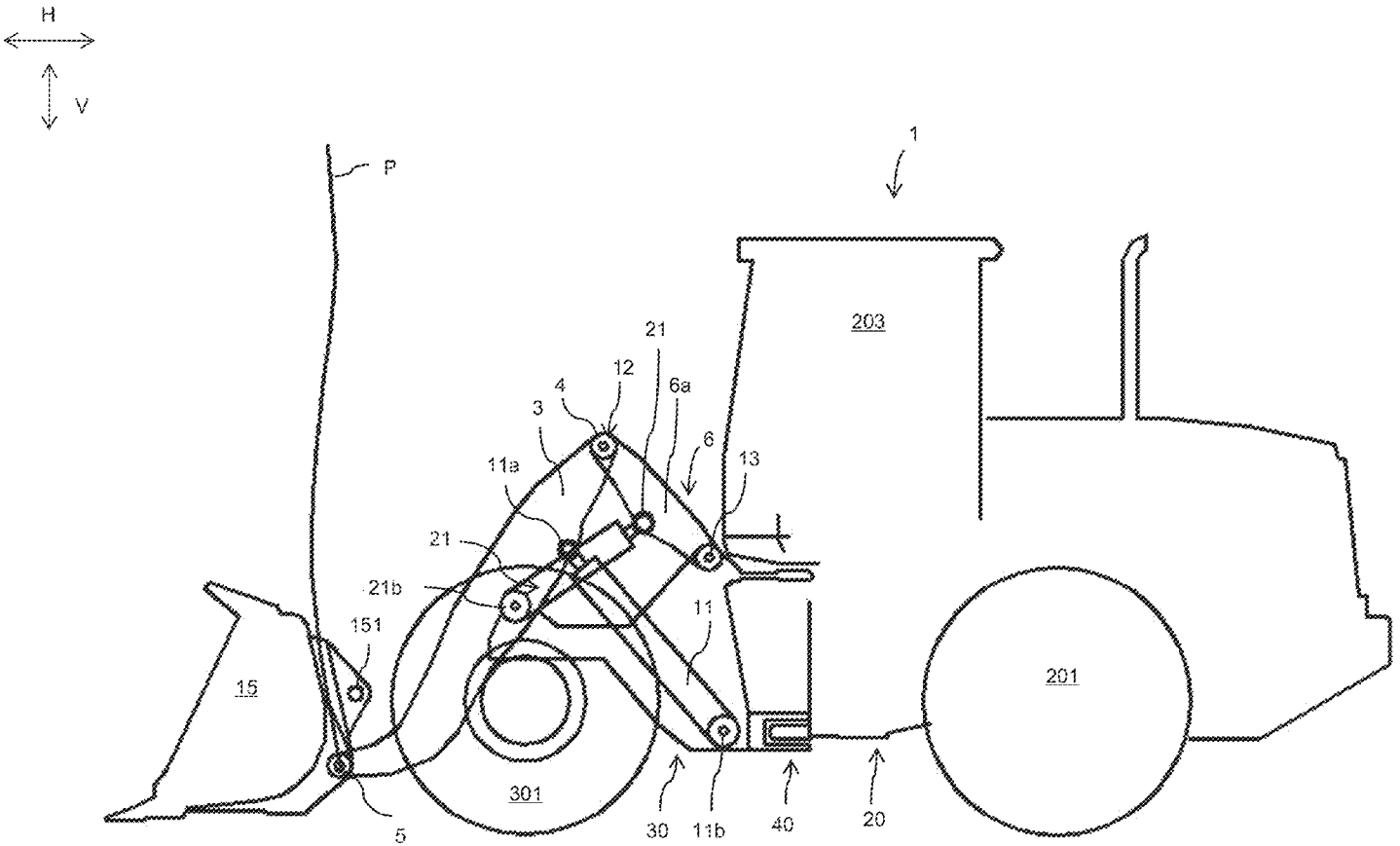
FIG. 7 illustrates a construction machine equipped with a lifting arrangement according to a third embodiment in a lowered position.
Figure 8:
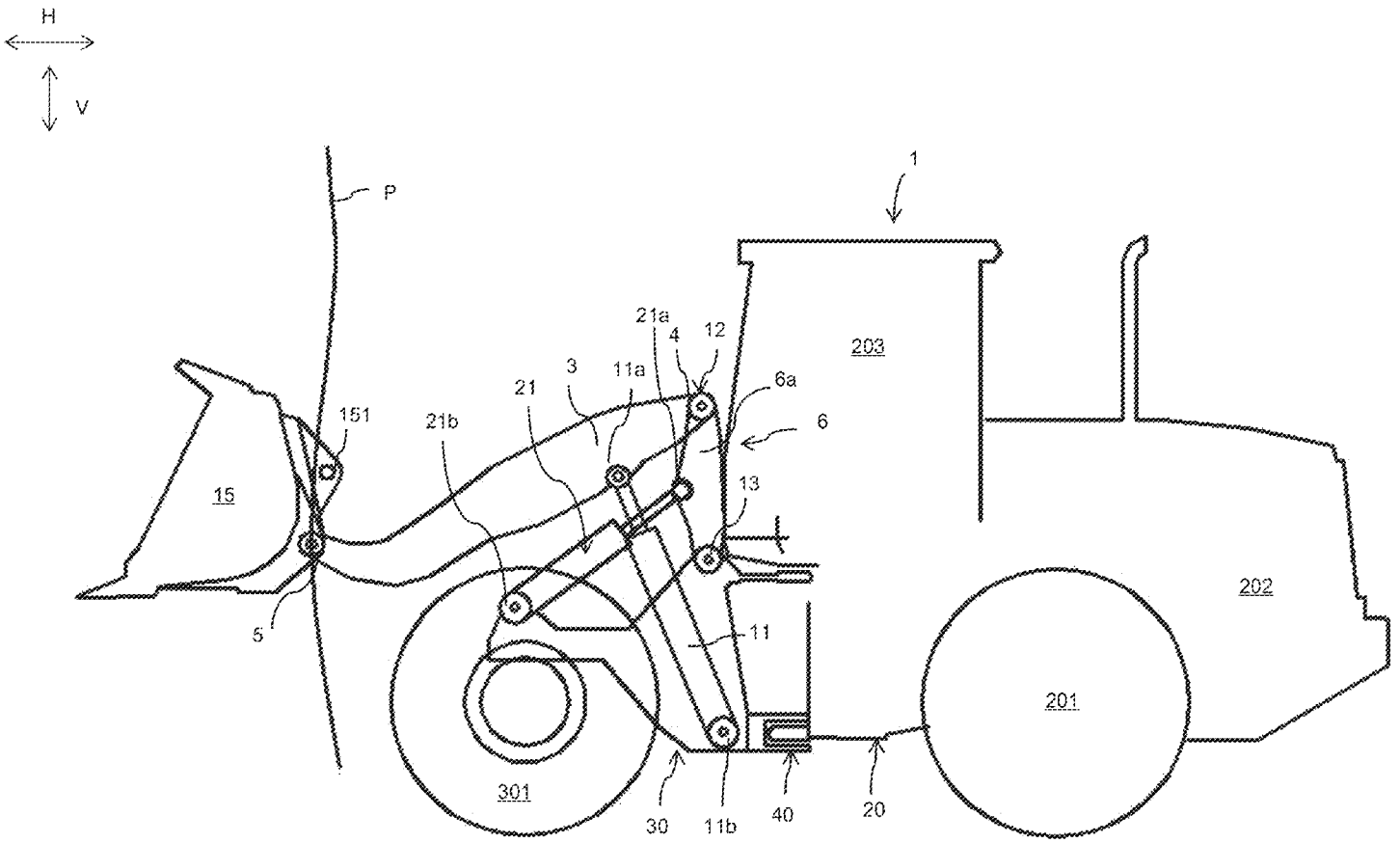
FIG. 8 illustrates a construction machine equipped with the lifting arrangement according to the third embodiment in an intermediate position.
Figure 9:
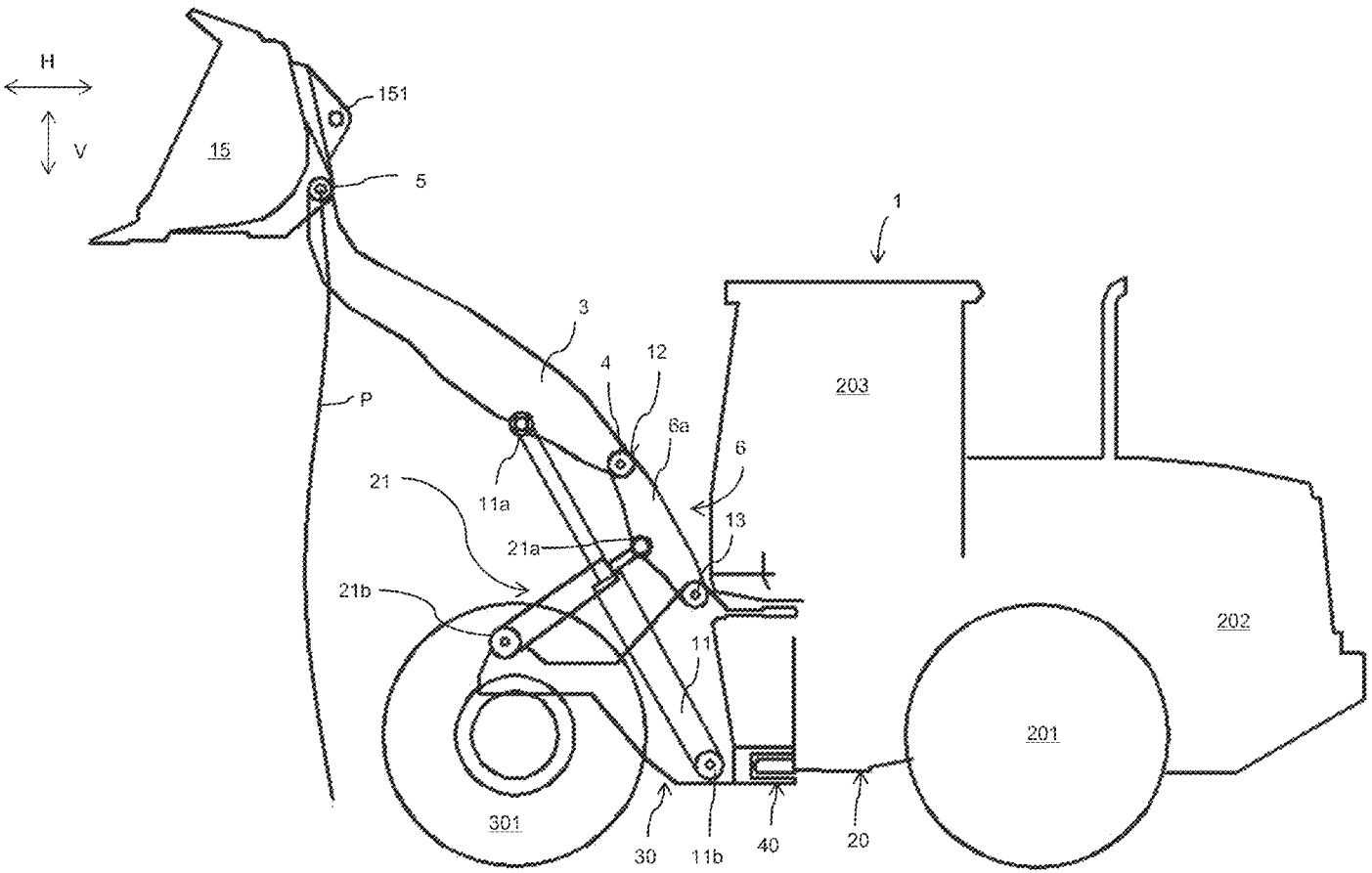
FIG. 9 illustrates a construction machine equipped with the lifting arrangement according to the third embodiment in a lifted position.

In the third embodiment shown in FIGS. 7-9, the auxiliary actuating element 21 is arranged in a different manner. As can be derived best from FIG. 8, the second end 21*b* of the auxiliary actuating element 21 is pivotably attached to a bearing attached to the front frame portion 30. The first end 21*a* of the auxiliary actuating element 21 is, as in the first embodiment, pivotably attached to the main arm support link 6*a*. Consequently, the main arm support link 6*a* can be moved, e.g. rotated about the second bearing portion 13 thereof by an operation of the auxiliary actuating element 21. The remaining arrangement is the same as in the first embodiment.

Figure 10:
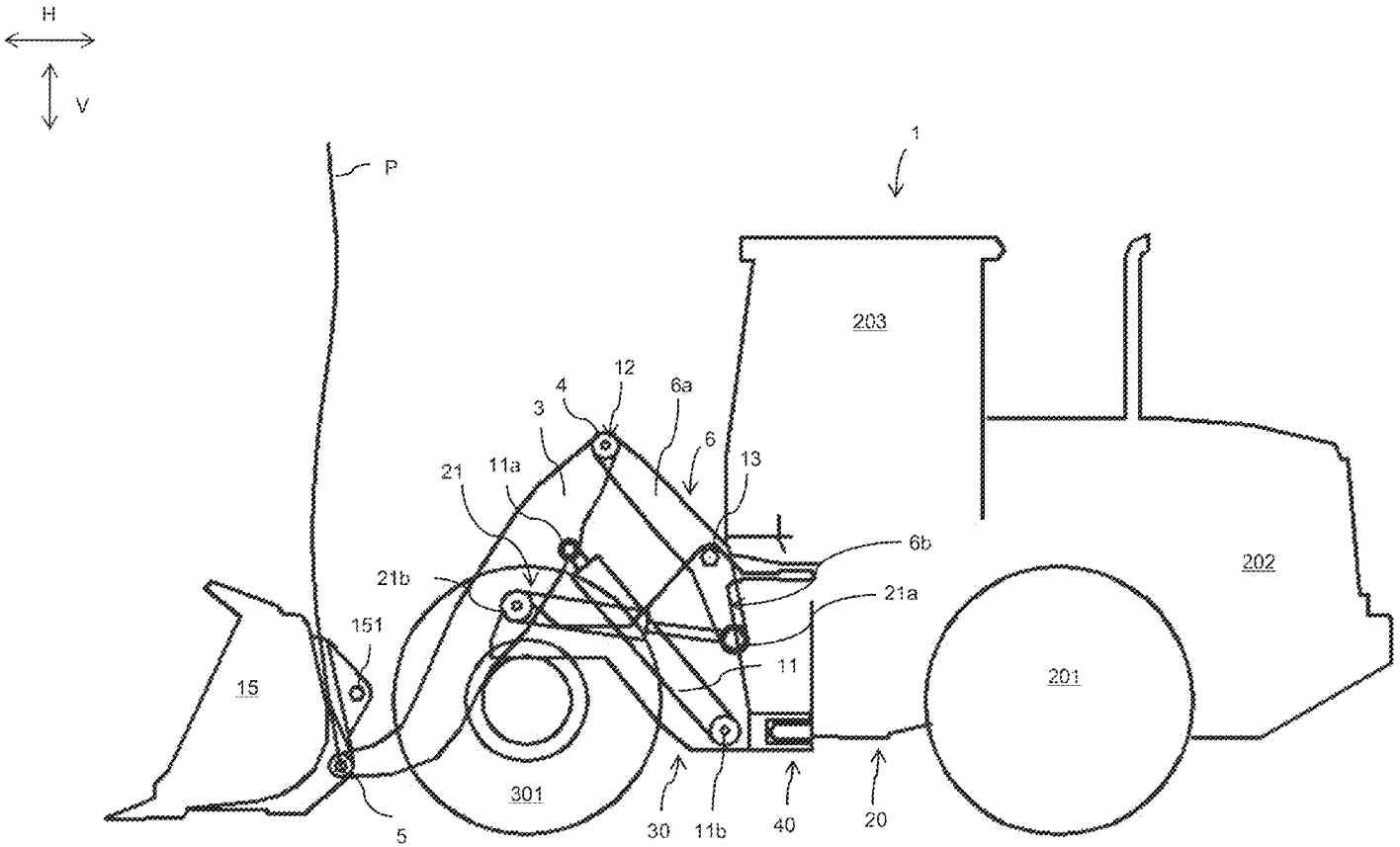
FIG. 10 illustrates a construction machine equipped with a lifting arrangement according to a fourth embodiment in a lowered position.
Figure 11:
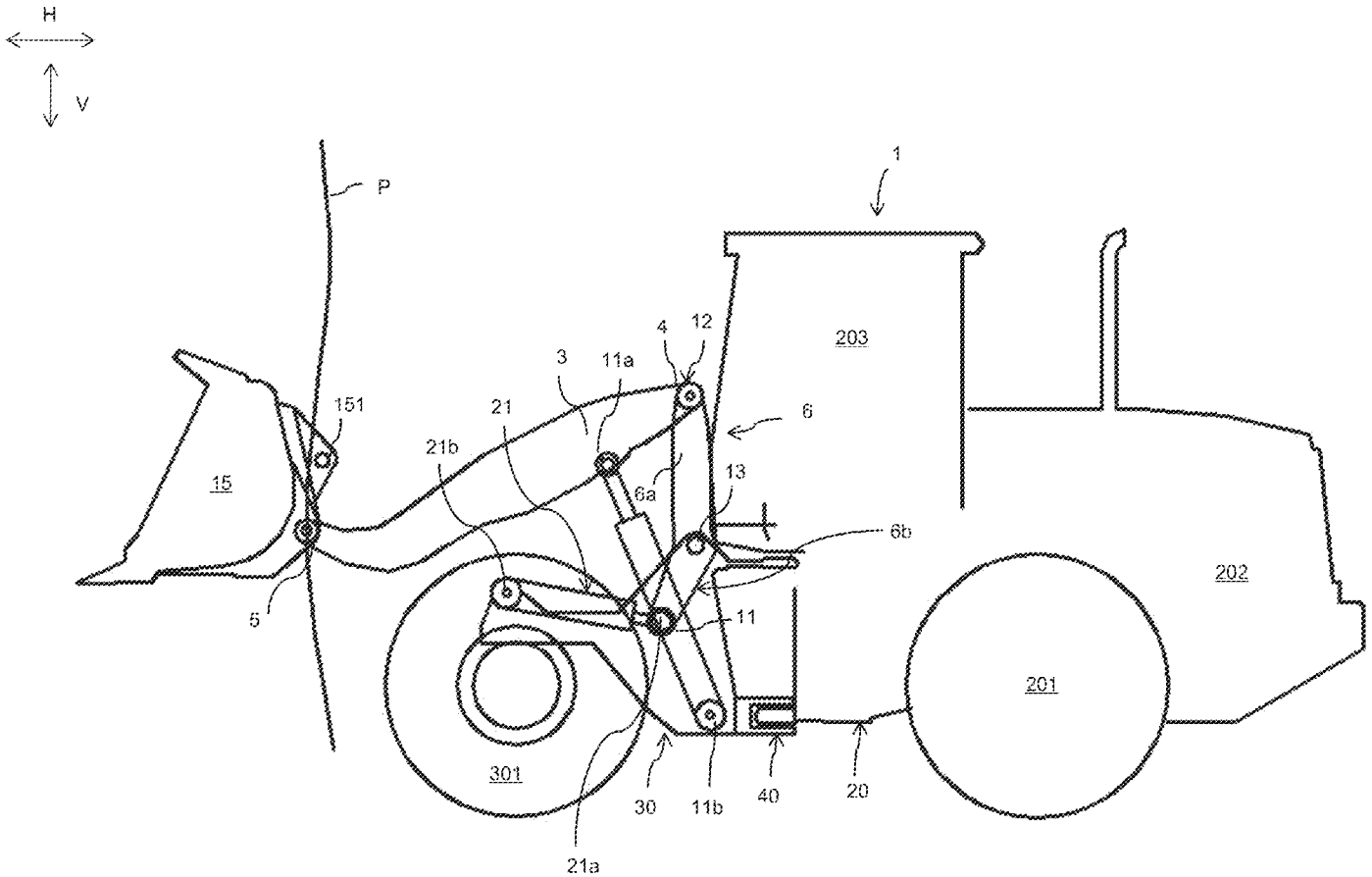
FIG. 11 illustrates a construction machine equipped with the lifting arrangement according to the fourth embodiment in an intermediate position.
Figure 12:
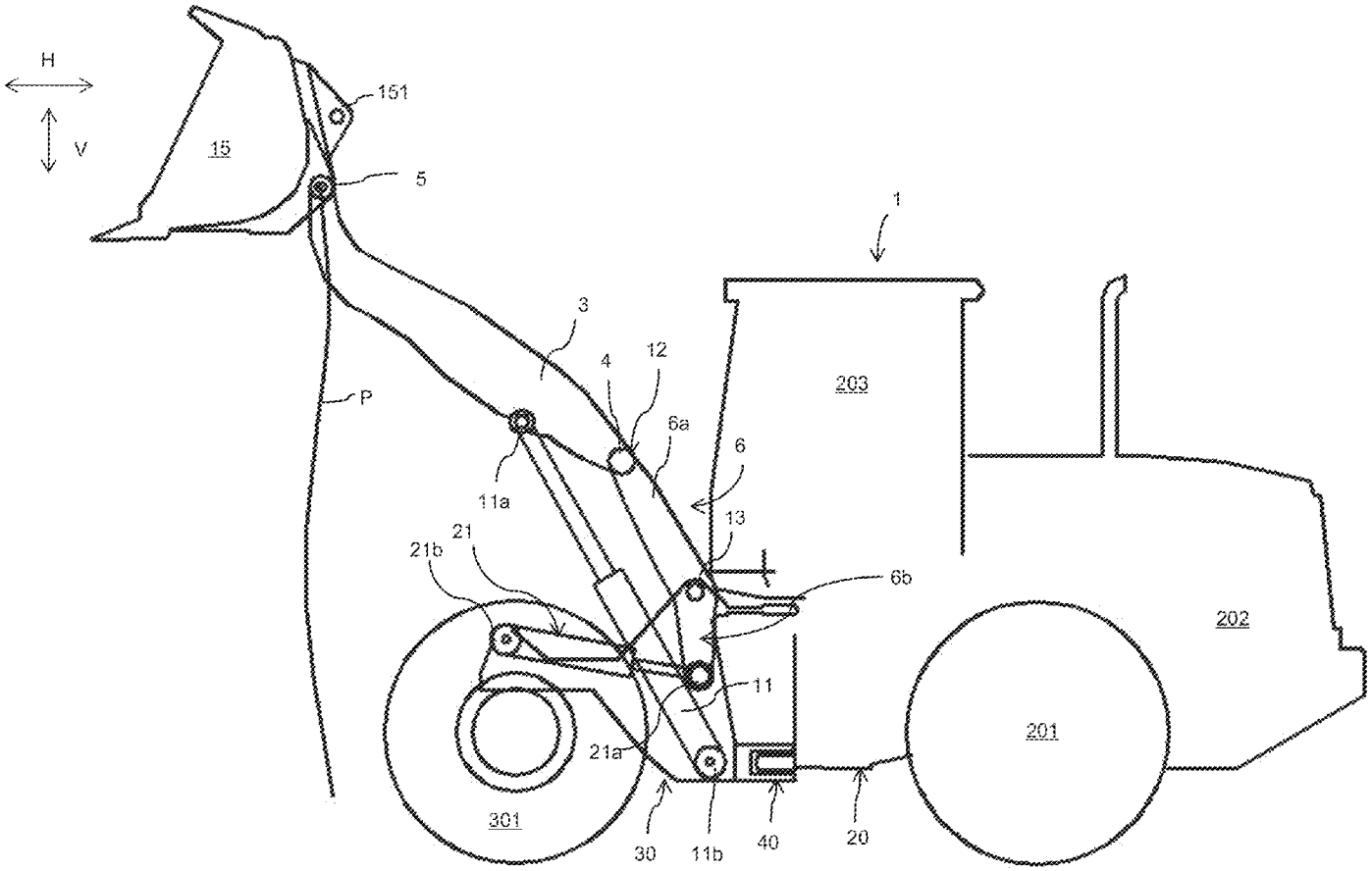
FIG. 12 illustrates a construction machine equipped with the lifting arrangement according to the fourth embodiment in a lifted position.

In the fourth embodiment shown in FIGS. 10-12, the auxiliary actuating element 21 is mounted in a different manner. As in the third embodiment, the second end 21*b* of the auxiliary actuating element 21 is pivotably mounted to a bearing attached to the front frame portion 30. However, the first end 21*a* of the auxiliary actuating element 21 is pivotably mounted to an actuation extension 6*b* which is mounted to the main arm support link 6*a*. In the present embodiment, the actuation extension 6*b* is mounted to the main arm support link on the opposite side with respect to the second bearing portion 13 of the main arm support link 6*a*. As can be derived from the drawings, the extension is slightly angled towards the main arm 3. The remaining arrangement is the same as in the first embodiment.

Figure 13:
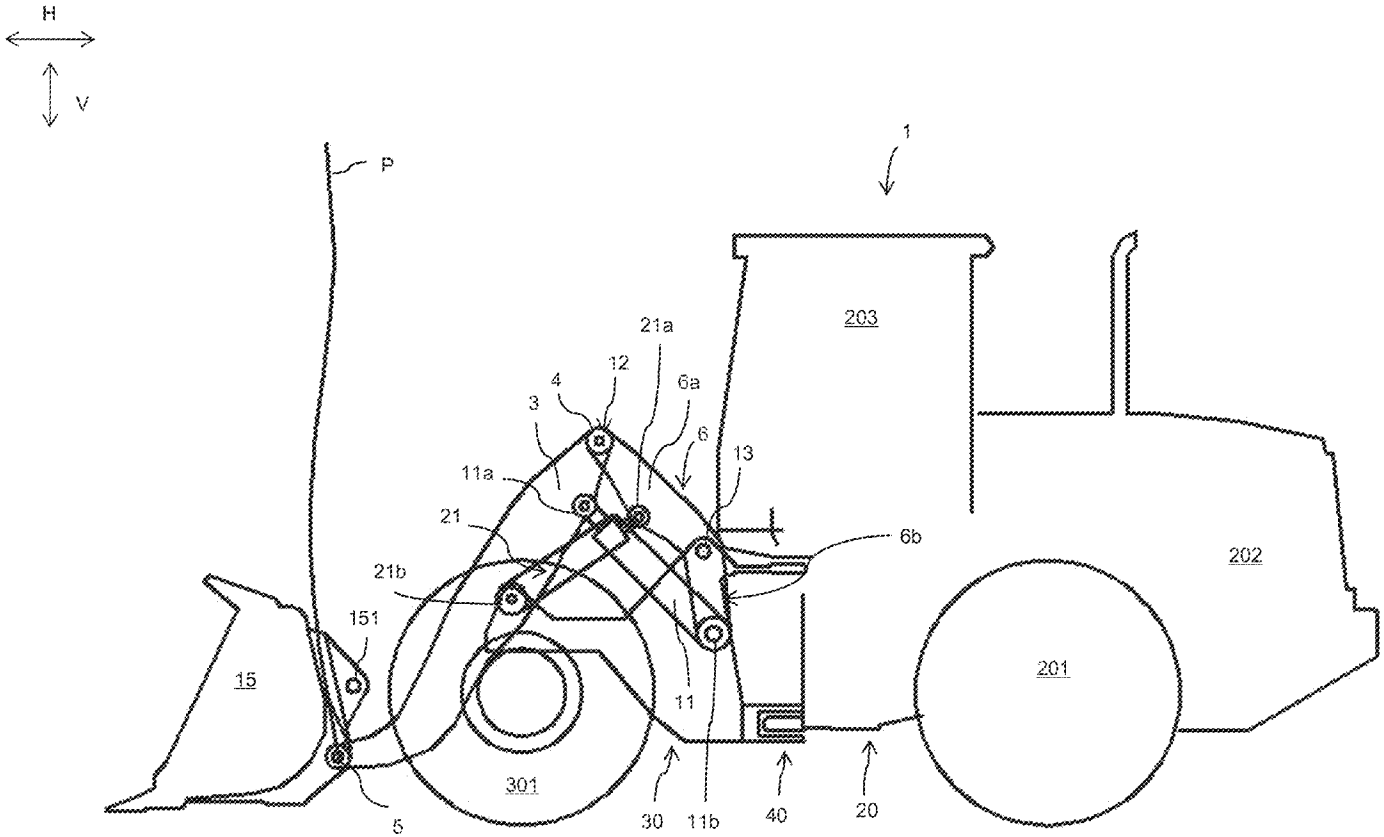
FIG. 13 illustrates a construction machine equipped with a lifting arrangement according to a fifth embodiment in a lowered position.
Figure 14:
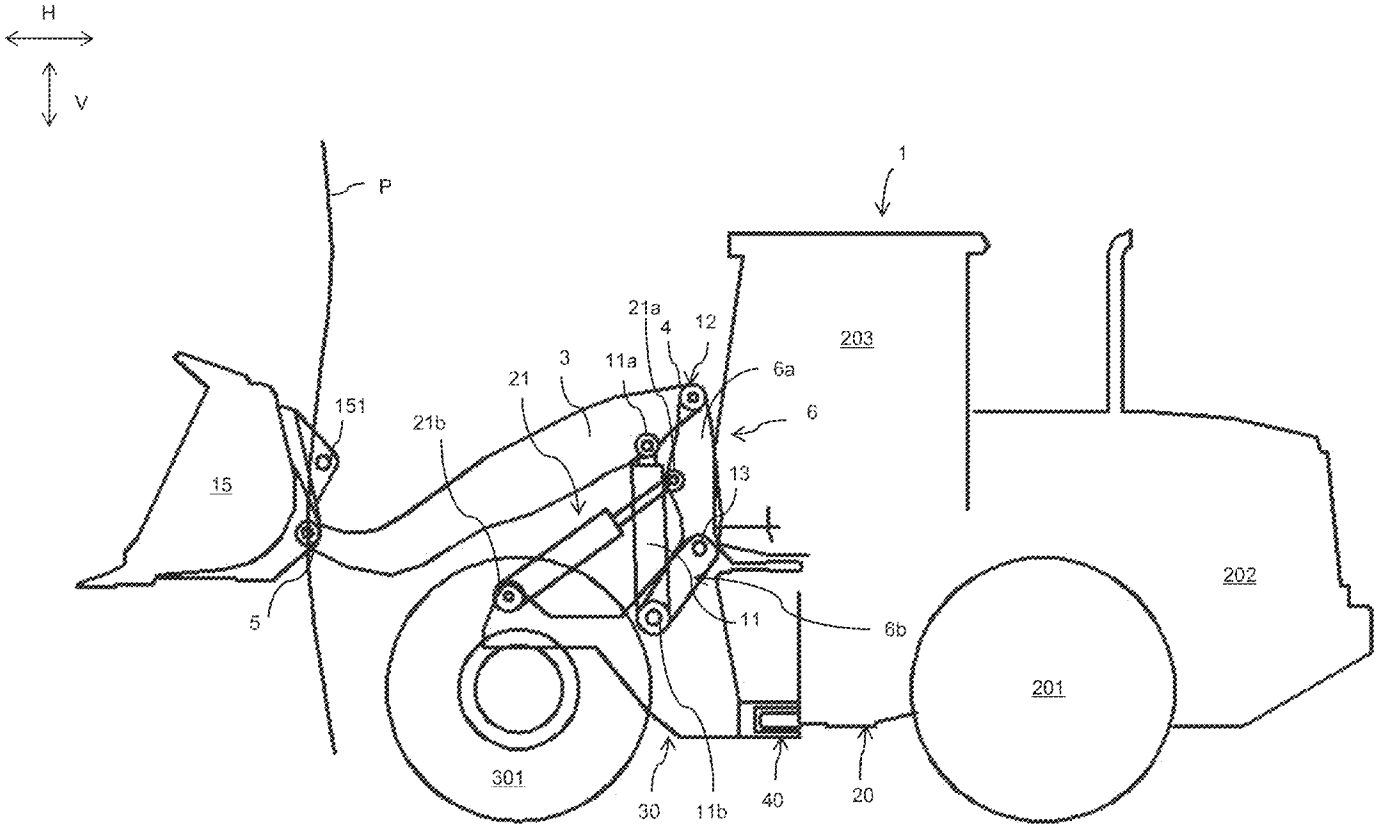
FIG. 14 illustrates a construction machine equipped with the lifting arrangement according to the fifth embodiment in an intermediate position.
Figure 15:
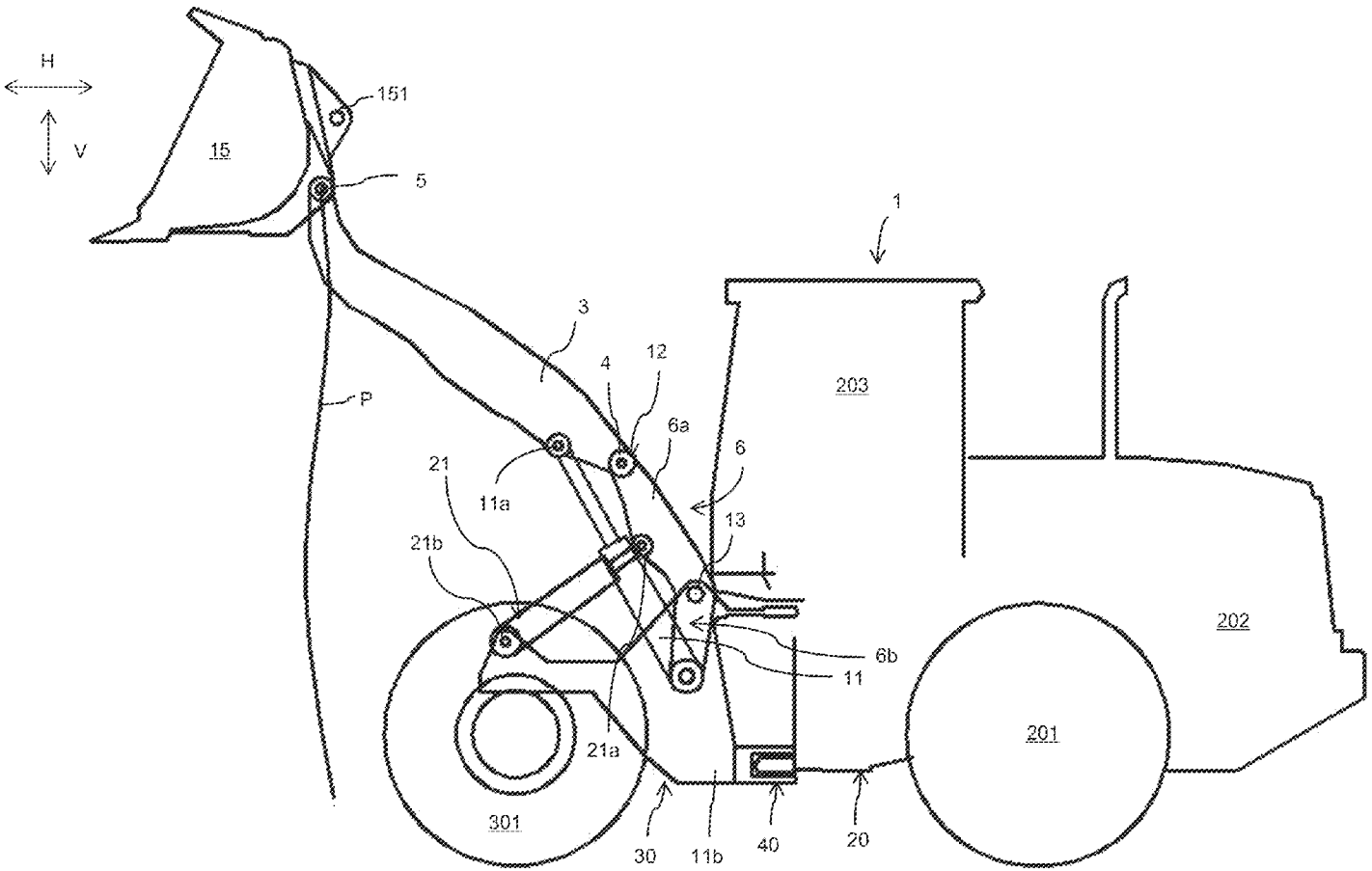
FIG. 15 illustrates a construction machine equipped with the lifting arrangement according to the fifth embodiment in a lifted position.

In the fifth embodiment shown in FIGS. 13-15, the auxiliary actuating element 21 is mounted to a bearing portion attached to the front frame portion 30 with its second end 21*b*. The first end 21*a* thereof is pivotably mounted to the main arm support link 6*a*. The main actuating element is attached with its first end 11*a* to the main arm 3. However, the second end 11*b* of the main arm actuating element 11 is attached to an actuation extension 6*b* which is mounted to the main arm support link 6*a* on the opposite side thereof with respect to the second bearing portion 13. As can be seen from the drawings, the actuation extension 6*b* is slightly inclined with respect to the main arm support link 6*a* towards the main arm 3. The remaining arrangement is the same as in the first embodiment.

Figure 16:
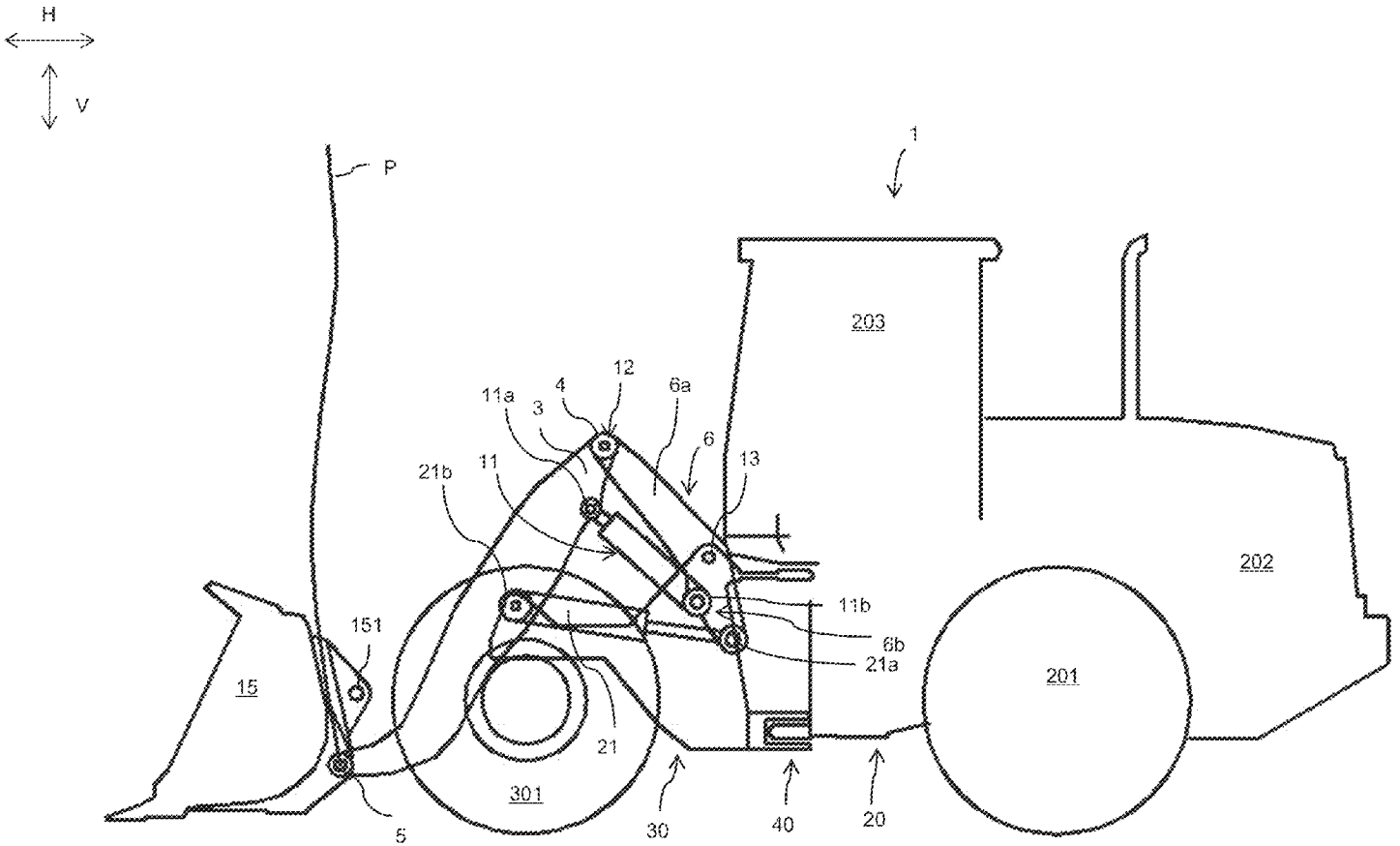
FIG. 16 illustrates a construction machine equipped with a lifting arrangement according to a sixth embodiment in a lowered position.
Figure 17:
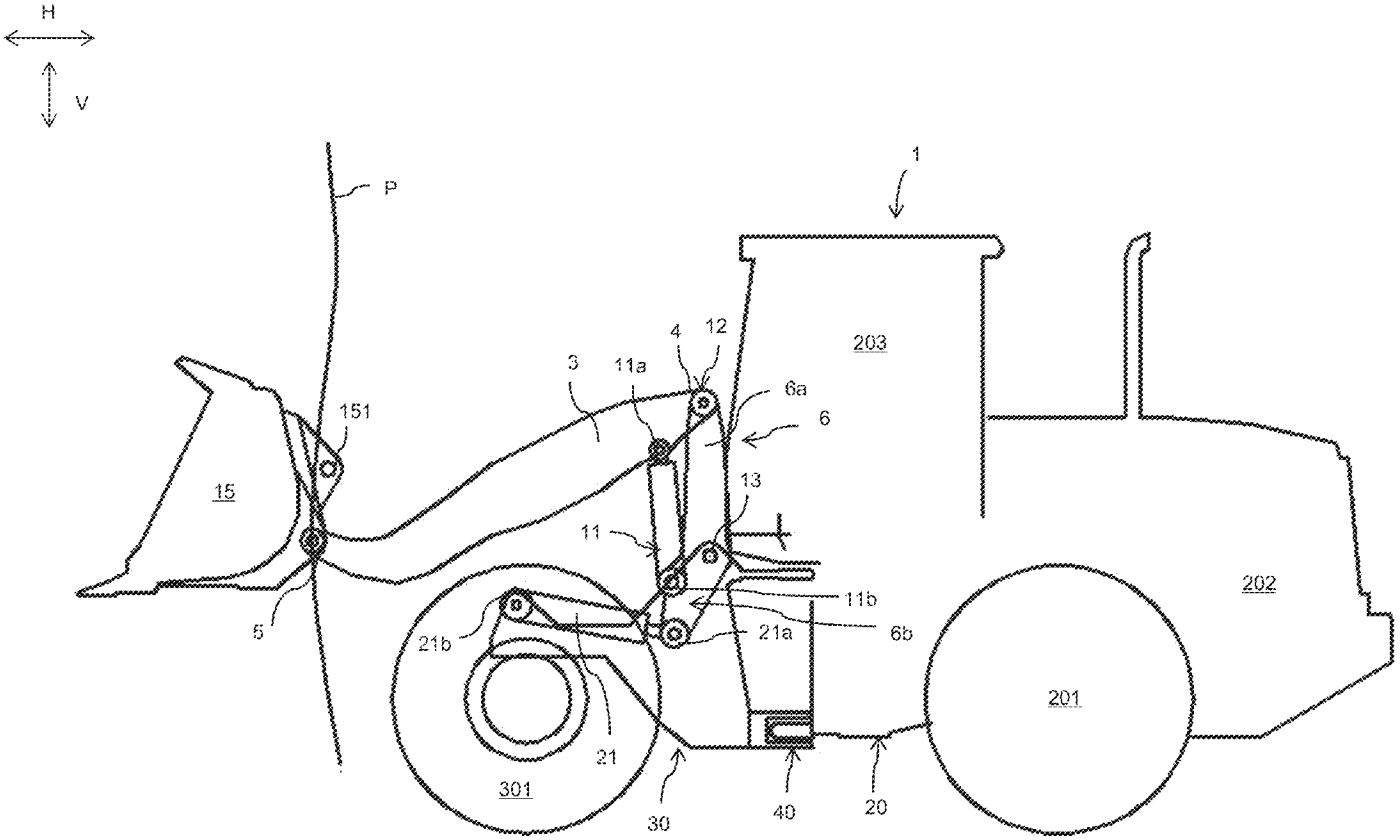
FIG. 17 illustrates a construction machine equipped with the lifting arrangement according to the sixth embodiment in an intermediate position.
Figure 18:
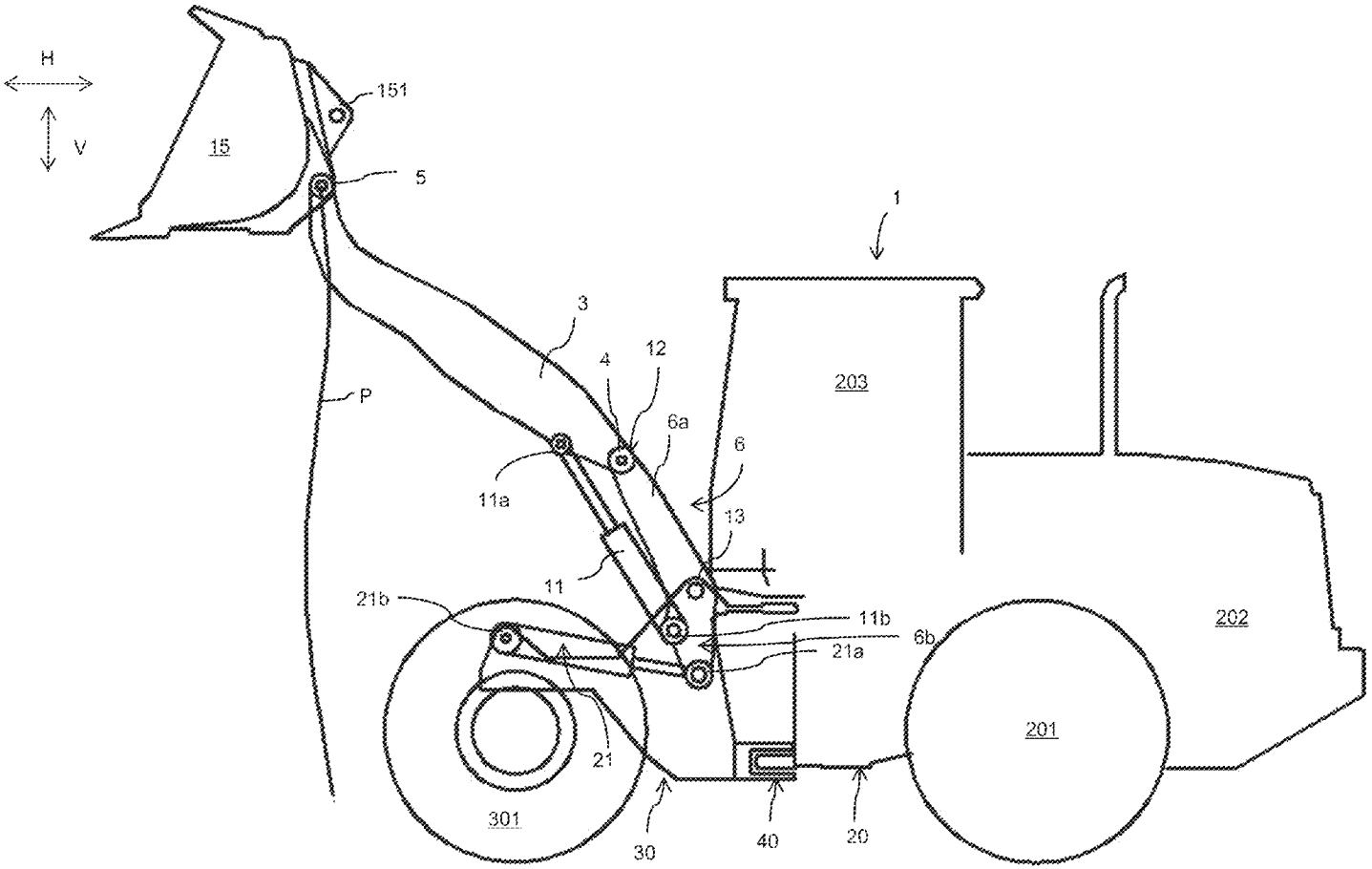
FIG. 18 illustrates a construction machine equipped with the lifting arrangement according to the sixth embodiment in a lifted position.

In the sixth embodiment shown in FIGS. 16-18, the auxiliary actuating element 21 is mounted to a bearing portion attached to the front frame portion 30 with its second end 21*b*. The first end 21*a* thereof is pivotably mounted to an extension 6*b* which is mounted to the main arm support link 6*a* on the opposite side thereof with respect to the second bearing portion 13. The main arm actuating element 11 is mounted with its first end to the main arm and with its second end 11*b* to a bearing portion attached to the front frame portion 30. The remaining arrangement is the same as in the first embodiment.

Figure 19:
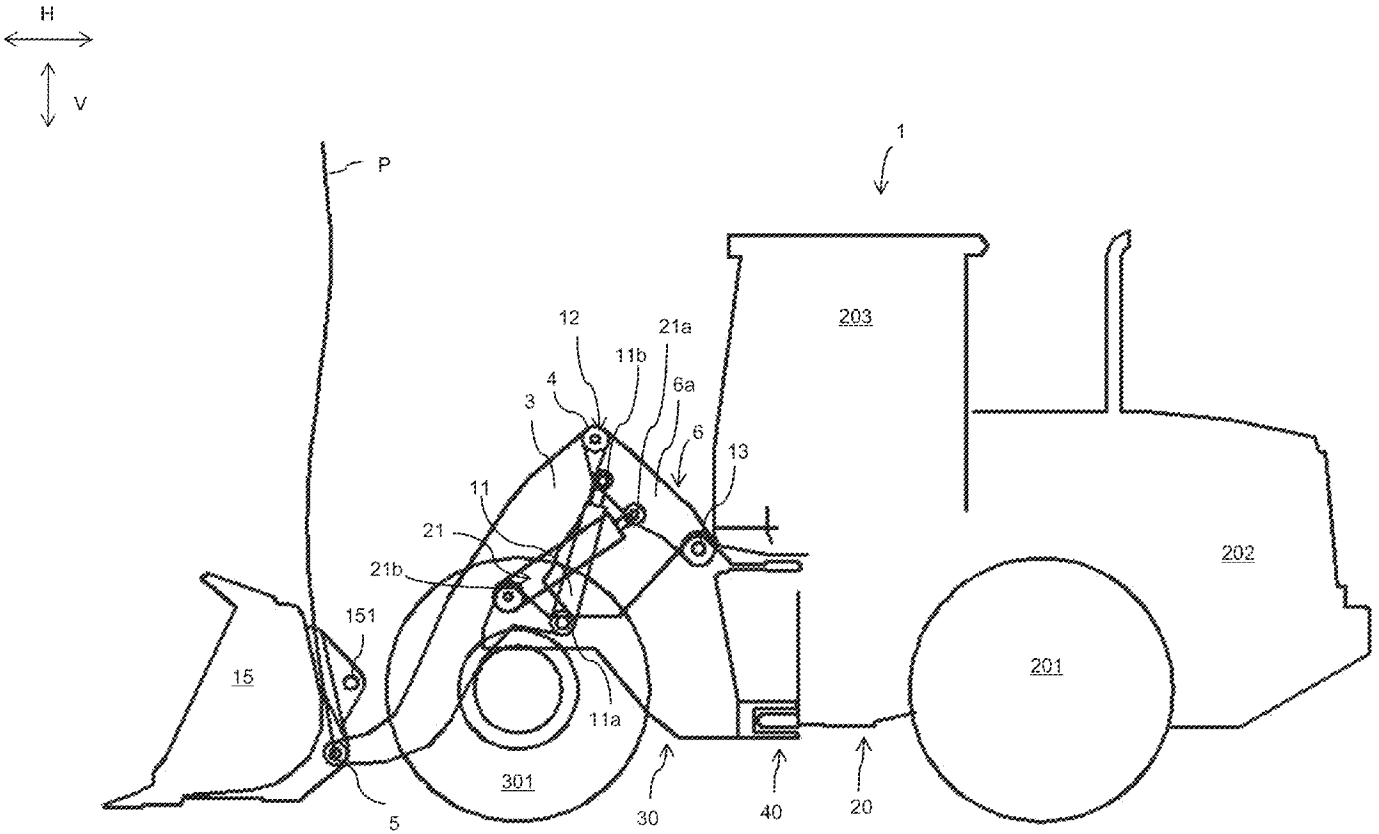
FIG. 19 illustrates a construction machine equipped with a lifting arrangement according to a seventh embodiment in a lowered position.
Figure 20:
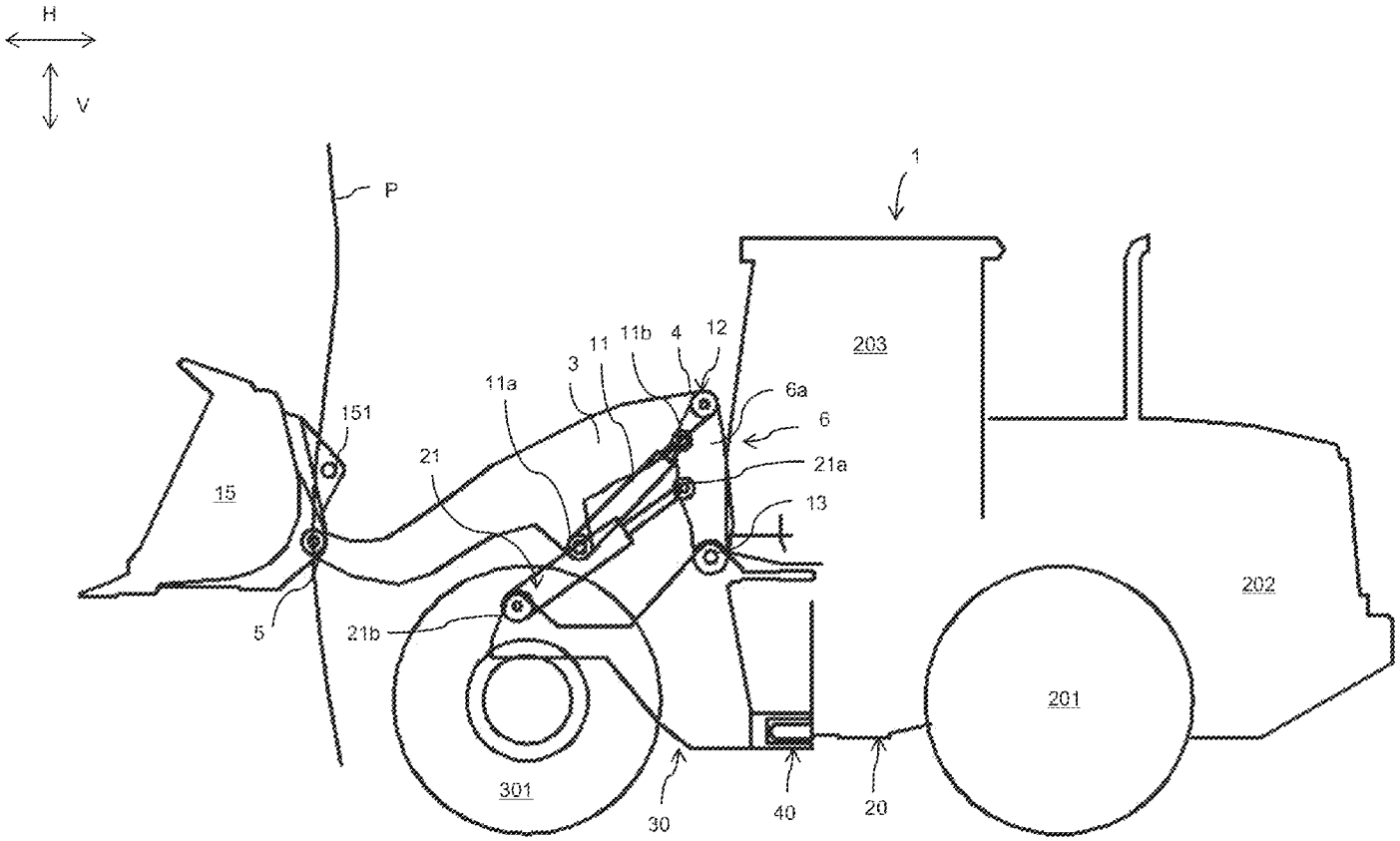
FIG. 20 illustrates a construction machine equipped with the lifting arrangement according to the seventh embodiment in an intermediate position.
Figure 21:
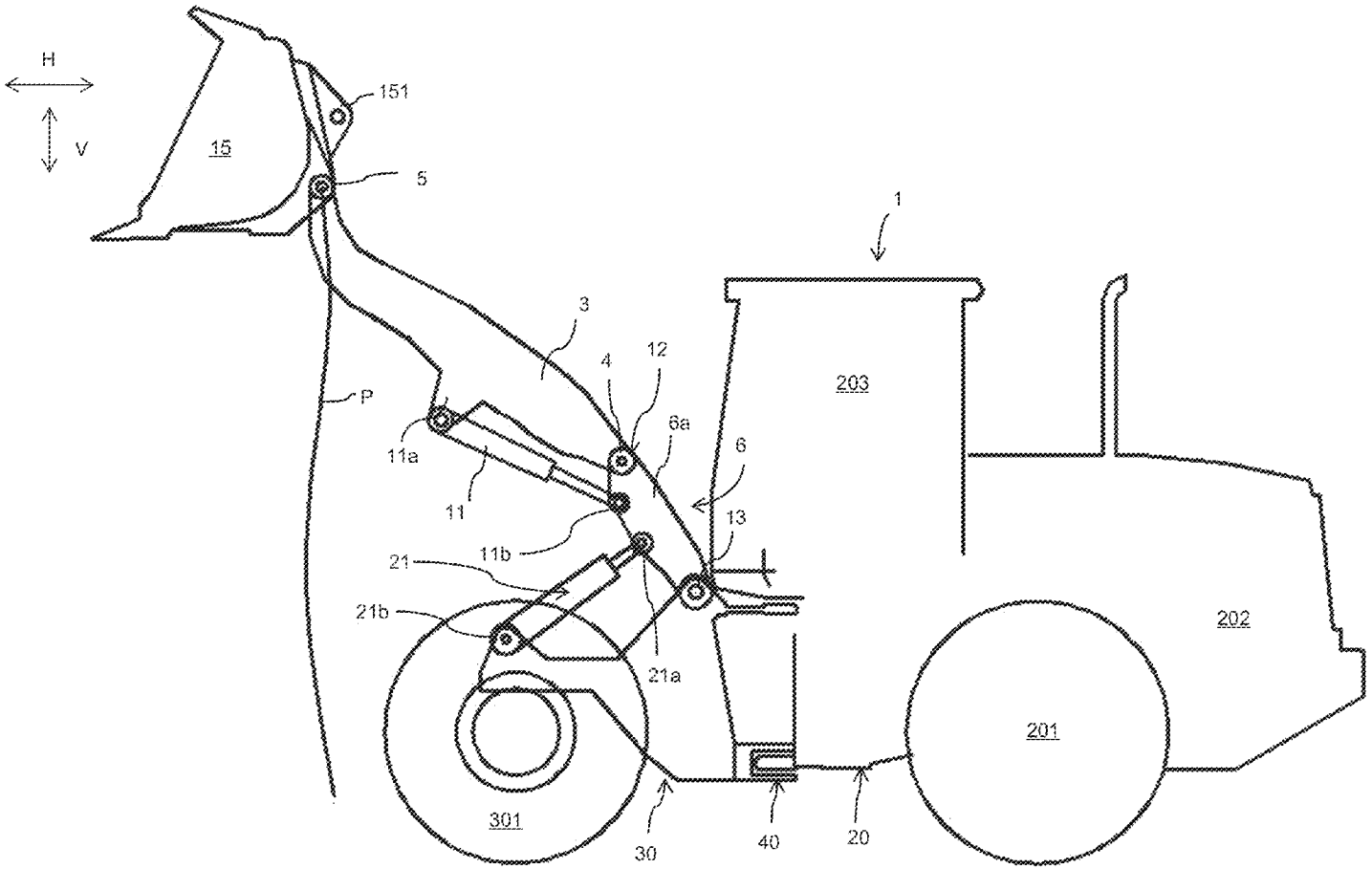
FIG. 21 illustrates a construction machine equipped with the lifting arrangement according to the seventh embodiment in a lifted position.

In the seventh embodiment shown in FIGS. 19-21 the auxiliary actuating element 21 is mounted with its second end 21*b* to a bearing portion attached to the front frame portion 30. The first end 21*a* thereof is pivotably mounted to the support link 6*a*. The main arm actuating element 11 is attached to the main arm 3 with its first end 11*a*, whereas its second end 11*b* is pivotably attached to the main arm support link 6*a*. In particular, the second end 11*b* of the main arm actuating element 11 is pivotably attached to the main arm support link 6*a* at a position between the pivot connector 4 and the position at which the first end 21*a* of the auxiliary actuating element 21 is attached to the main arm support link 6*a*. Moreover, as can be derived from FIG. 21, the first end 11*a* of the main arm actuating element 11 is attached to the main arm 3 at an extension such that the point of rotation at the first end 11*a* of the main arm actuating element deviates from a line connecting the equipment connector 5 and the pivot connector 4. In particular, this extension protrudes to the side on which the main arm actuating element 11 is arranged with respect to the main arm 3. The remaining arrangement is the same as in the first embodiment.

Figure 22:
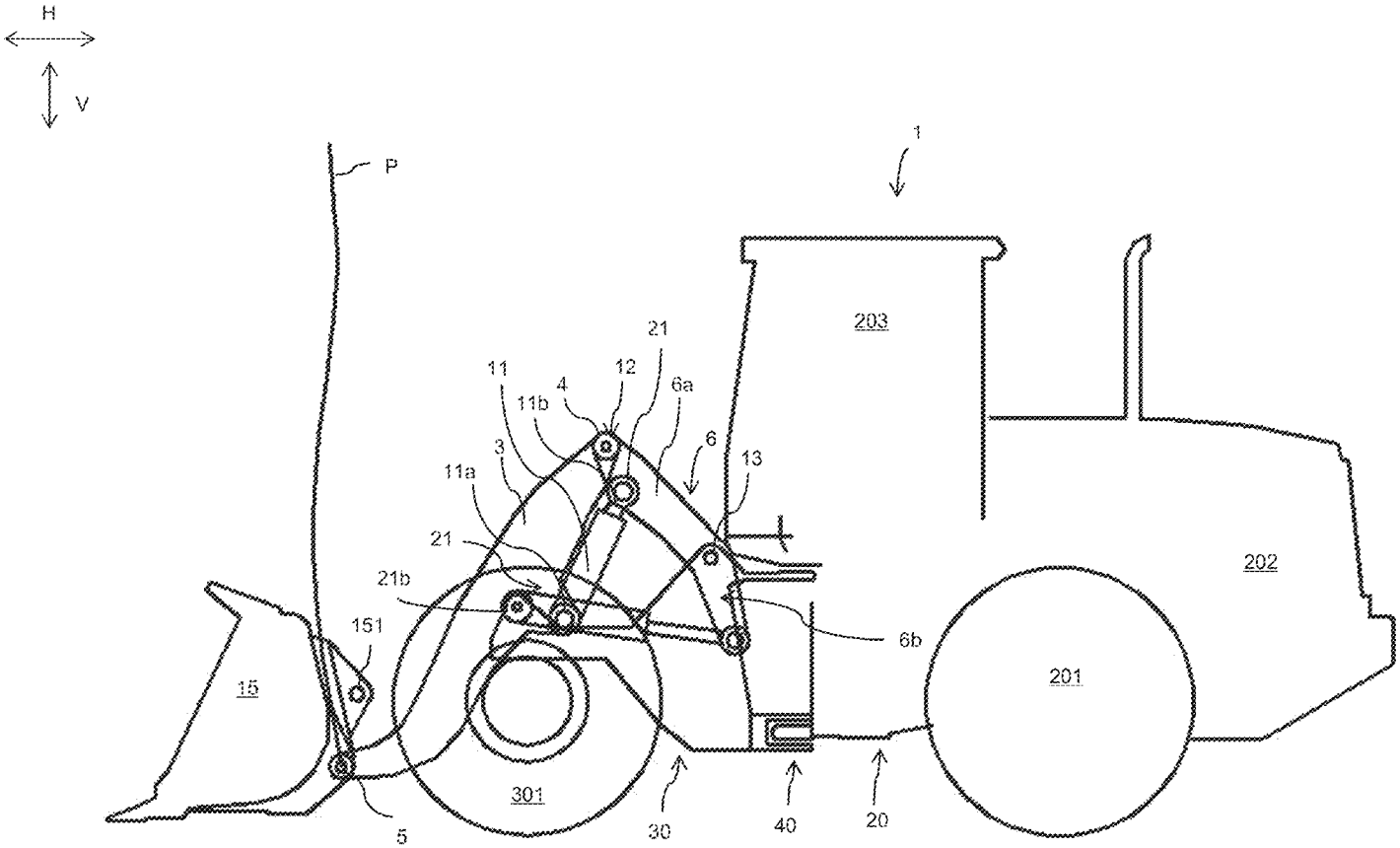
FIG. 22 illustrates a construction machine equipped with a lifting arrangement according to an eighth embodiment in a lowered position.
Figure 23:
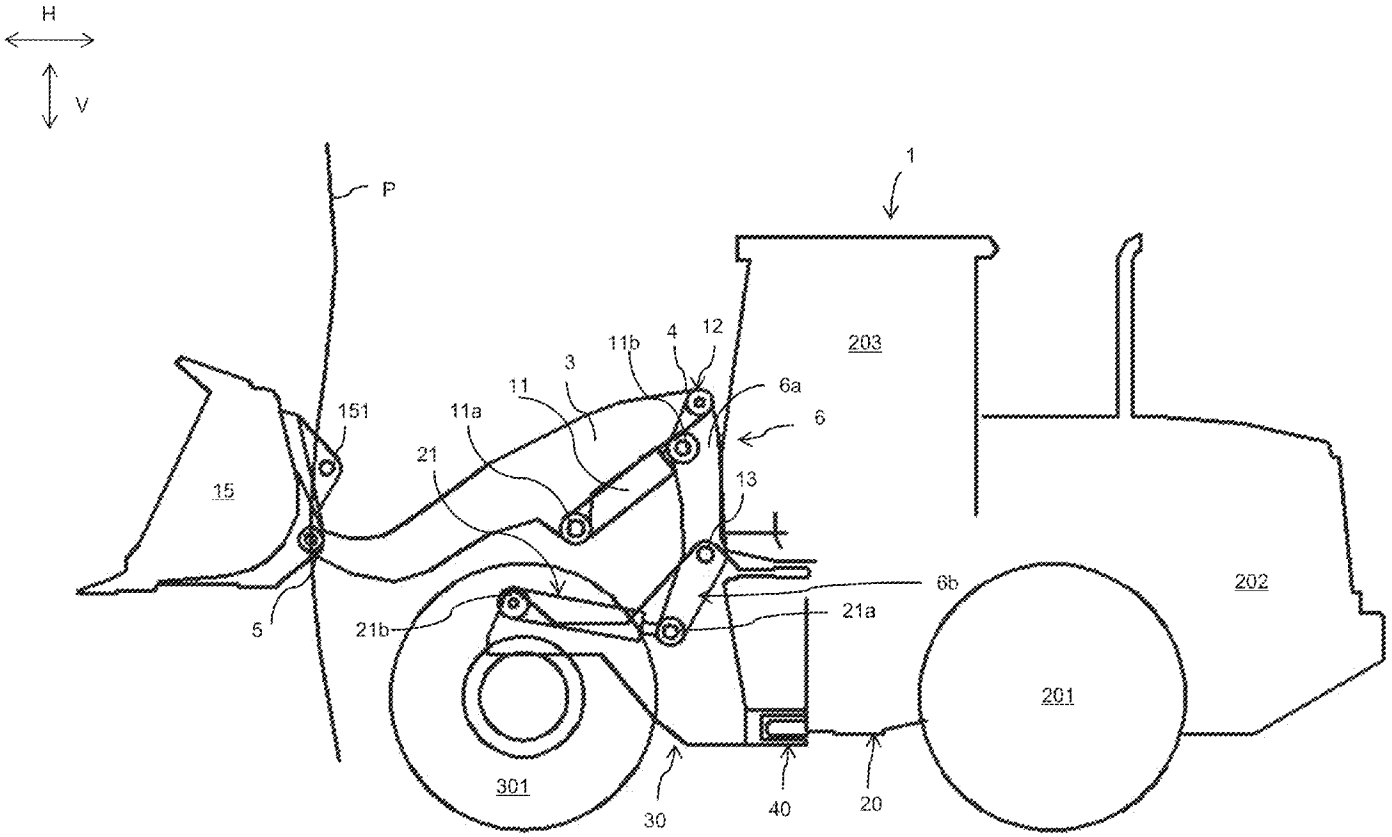
FIG. 23 illustrates a construction machine equipped with the lifting arrangement according to the eighth embodiment in an intermediate position.
Figure 24:
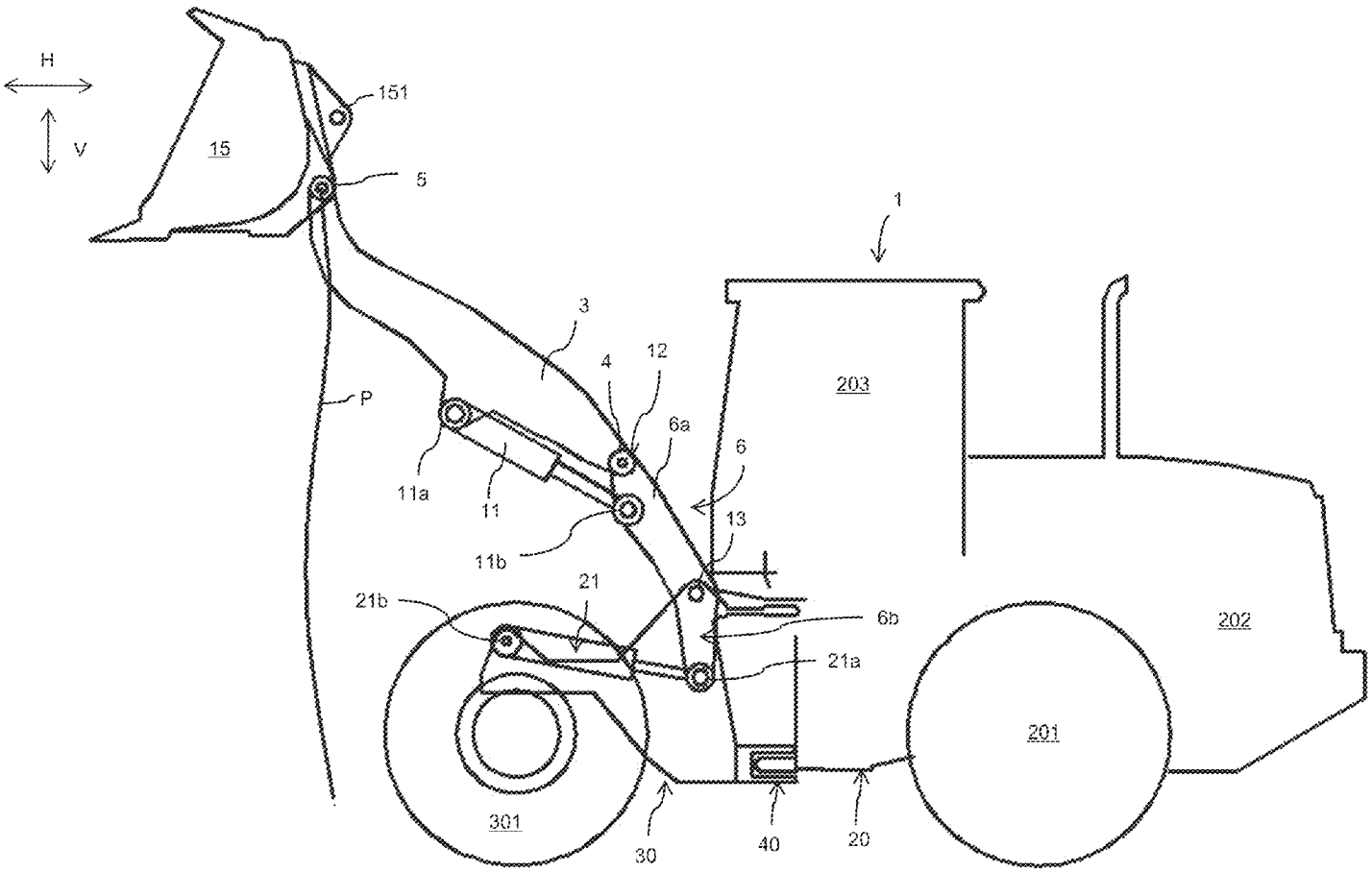
FIG. 24 illustrates a construction machine equipped with the lifting arrangement according to the eighth embodiment in a lifted position.

In an eighth embodiment shown in FIGS. 22-24, the main arm actuating element 11 is arranged as in the seventh embodiment. The auxiliary actuating element 21 is with its second end 21*b* mounted to a bearing portion attached to the front frame portion 30. The first end 21*a* of the auxiliary actuating element 21 is pivotably attached to an actuation extension 6*b* which is arranged on the opposite side of the main arm support link 6*a* with respect to the second bearing portion 13 thereof. The remaining arrangement is the same as in the first embodiment.

Figure 25:
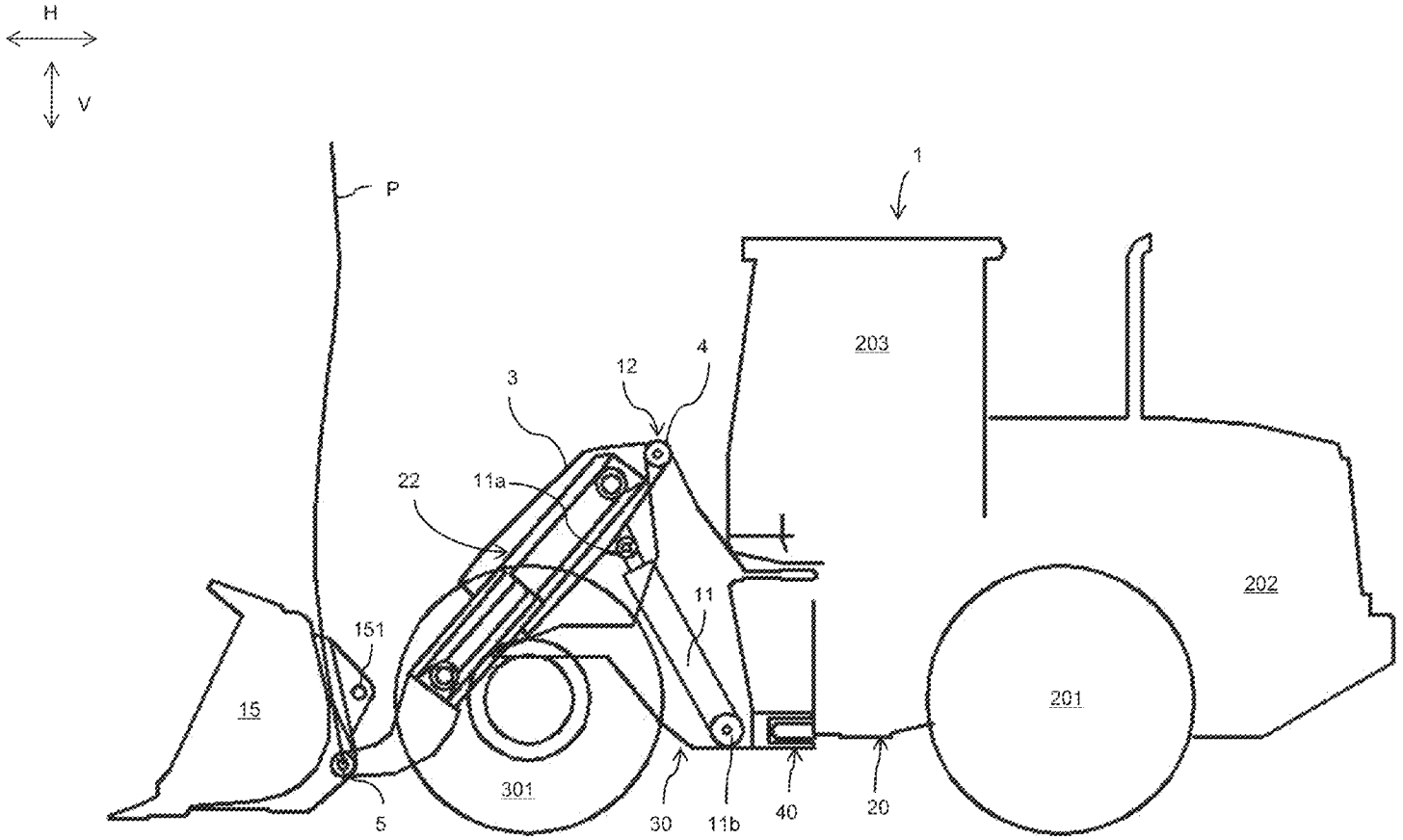
FIG. 25 illustrates a construction machine equipped with a lifting arrangement according to a ninth embodiment in a lowered position.
Figure 26:
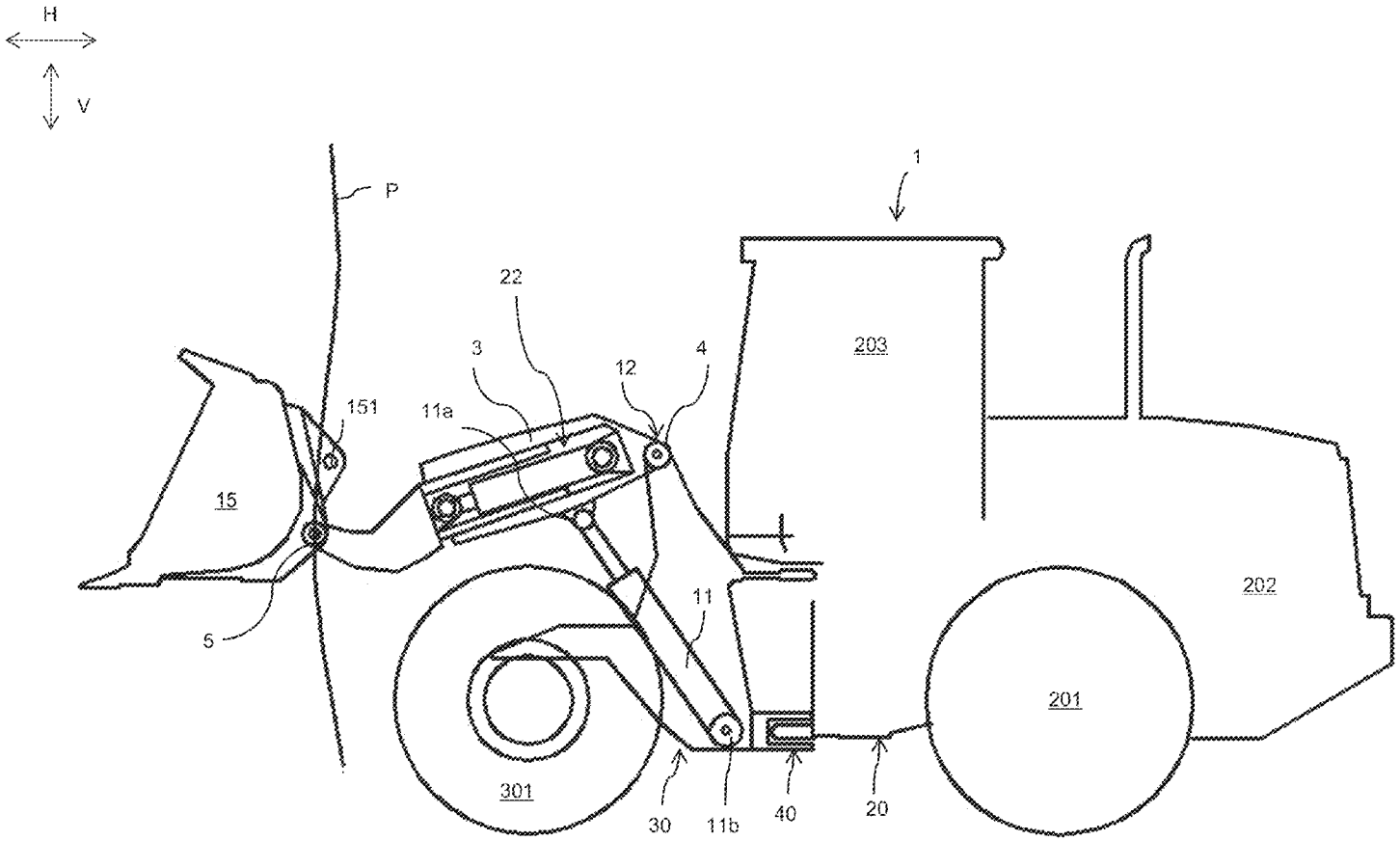
FIG. 26 illustrates a construction machine equipped with the lifting arrangement according to the ninth embodiment in an intermediate position.
Figure 27:
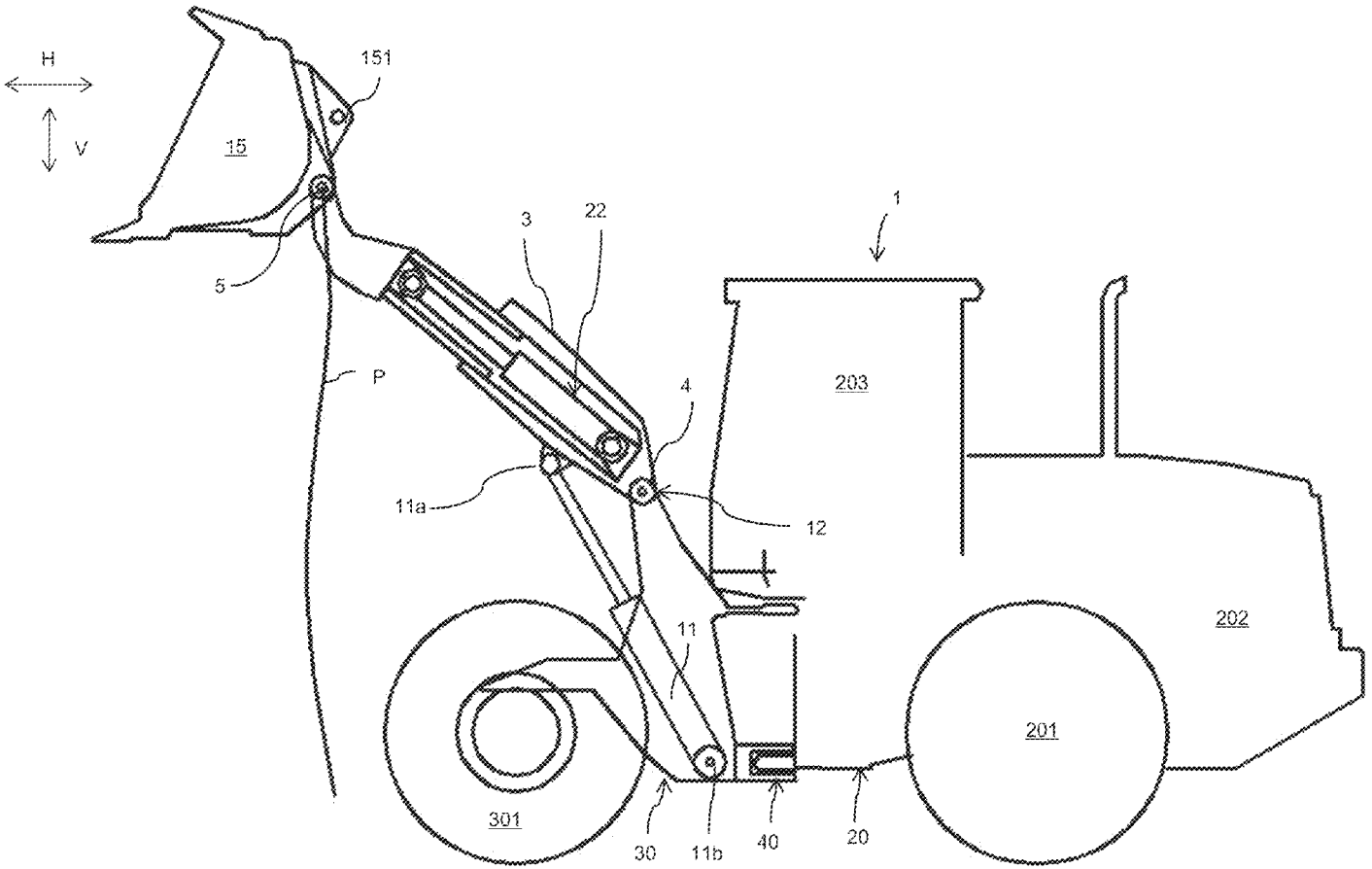
FIG. 27 illustrates a construction machine equipped with the lifting arrangement according to the ninth embodiment in a lifted position.

An ninth embodiment is shown in FIGS. 25-27. While the arrangement of the main actuating element 11 is the same as in the first embodiment, the present embodiment differs from the previous embodiments in that the pivot connector 4 is arranged stationary with respect to the front frame portion 30. In addition, an auxiliary actuating element 22 is provided in combination with the main arm 3 as can be derived from FIG. 26. As can be seen, the auxiliary actuating element 22 is formed as linear actuator which is mounted aligned to the extension direction of the main arm 3. One end of the auxiliary actuating element 22, e.g. the end facing backwards, is fixedly mounted to the main arm 3. The other end of the auxiliary actuating element 22 is engaged to a portion carrying the equipment connector 5. An extending or retracting operation of the auxiliary actuating element 22 according to the present embodiment leads to a translatory movement of the equipment connector 5 in a direction which includes at least a component in the front-rear direction with respect to the frame arrangement of the construction machine. The main arm 3 can include a slide or guide arrangement in order to provide the translatory movement of the element carrying the equipment connector 5. This slide or guide arrangement is translatory driven by the auxiliary actuating element 22.

The above discussed control system can be applied to the above ninth embodiment in the same manner in order to achieve a predetermined path along which the equipment connector follows upon a lifting operation from the lower position shown in FIG. 25 to a lift position shown in FIG. 27 through an intermediate position shown in FIG. 26. The advantages of the present embodiment are the same as in the previous embodiments. In particular, it is possible to provide a movement pattern of the equipment connector 5 along a substantially vertical path or within a predetermined vertical range in order to reduce the tilting moment exerted by the load to the construction machine upon a lifting operation, in particular, in the intermediate lifting position shown in FIG. 26. The control system and the structure of the construction machine to which the lifting arrangement according to the present embodiment can be applied are the same as in the previous embodiments.

Figure 28:
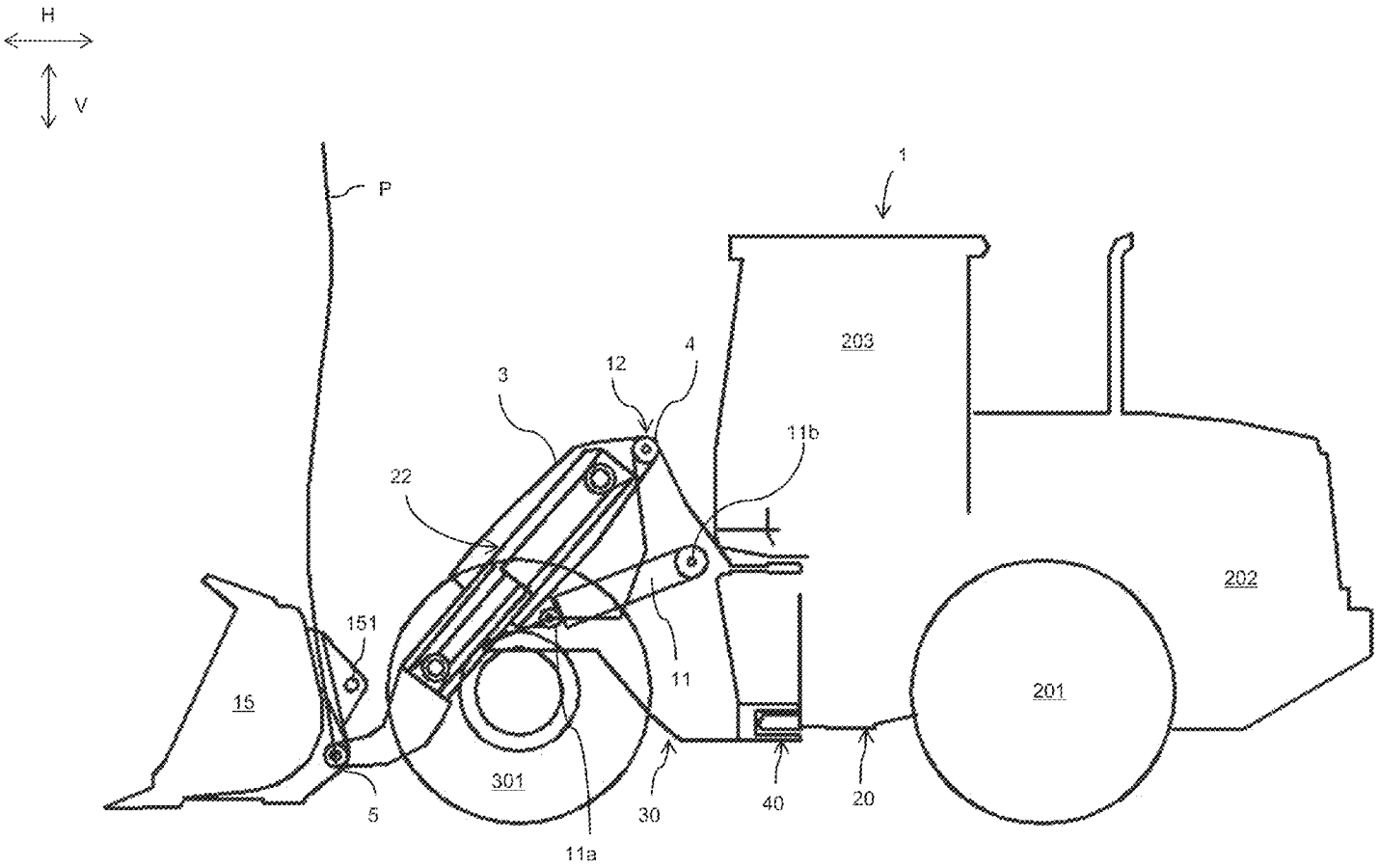
FIGS. 28 to 30 illustrate a construction machine equipped with a lifting arrangement according to a modification of the ninth embodiment.
Figure 29:
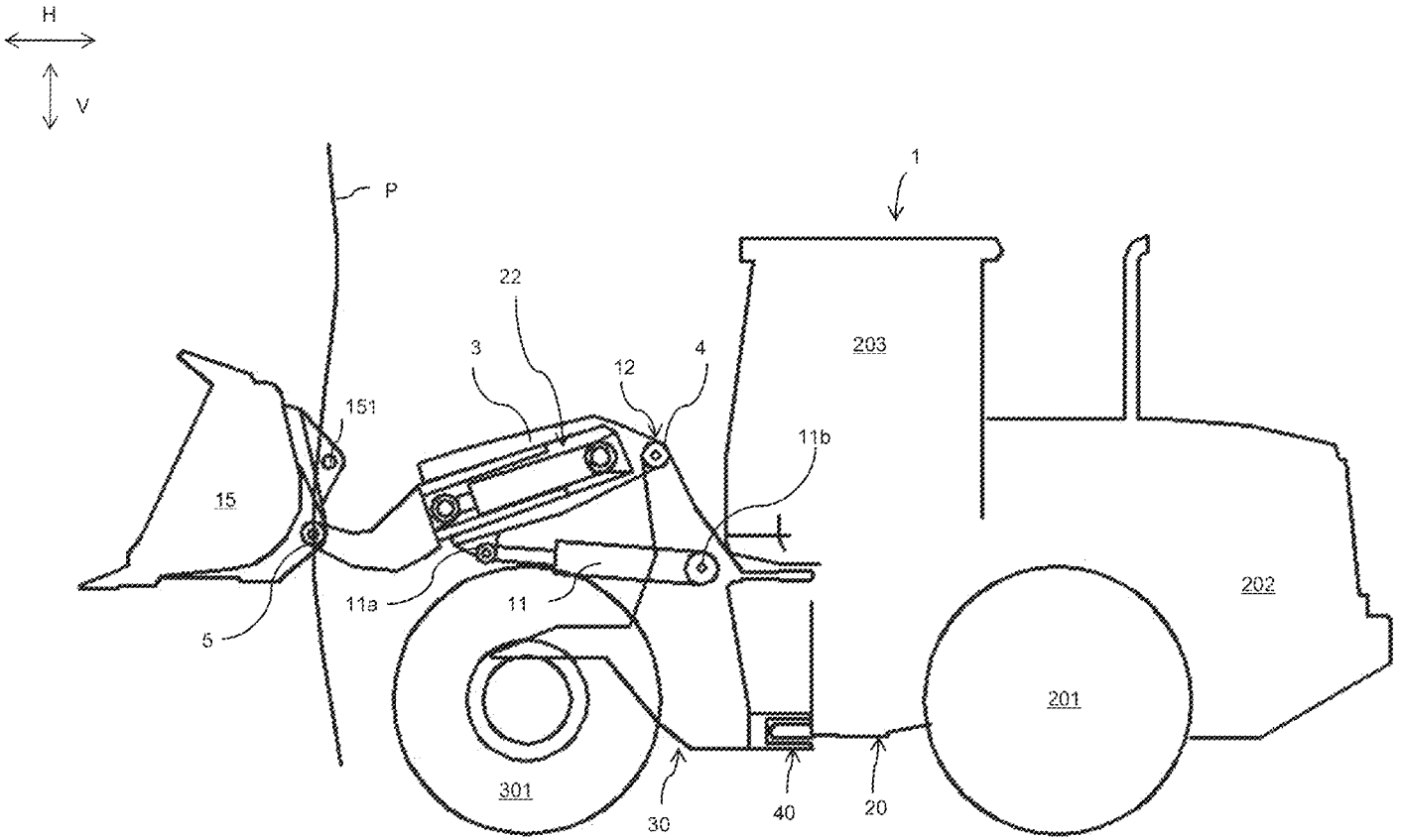
Figure 30:
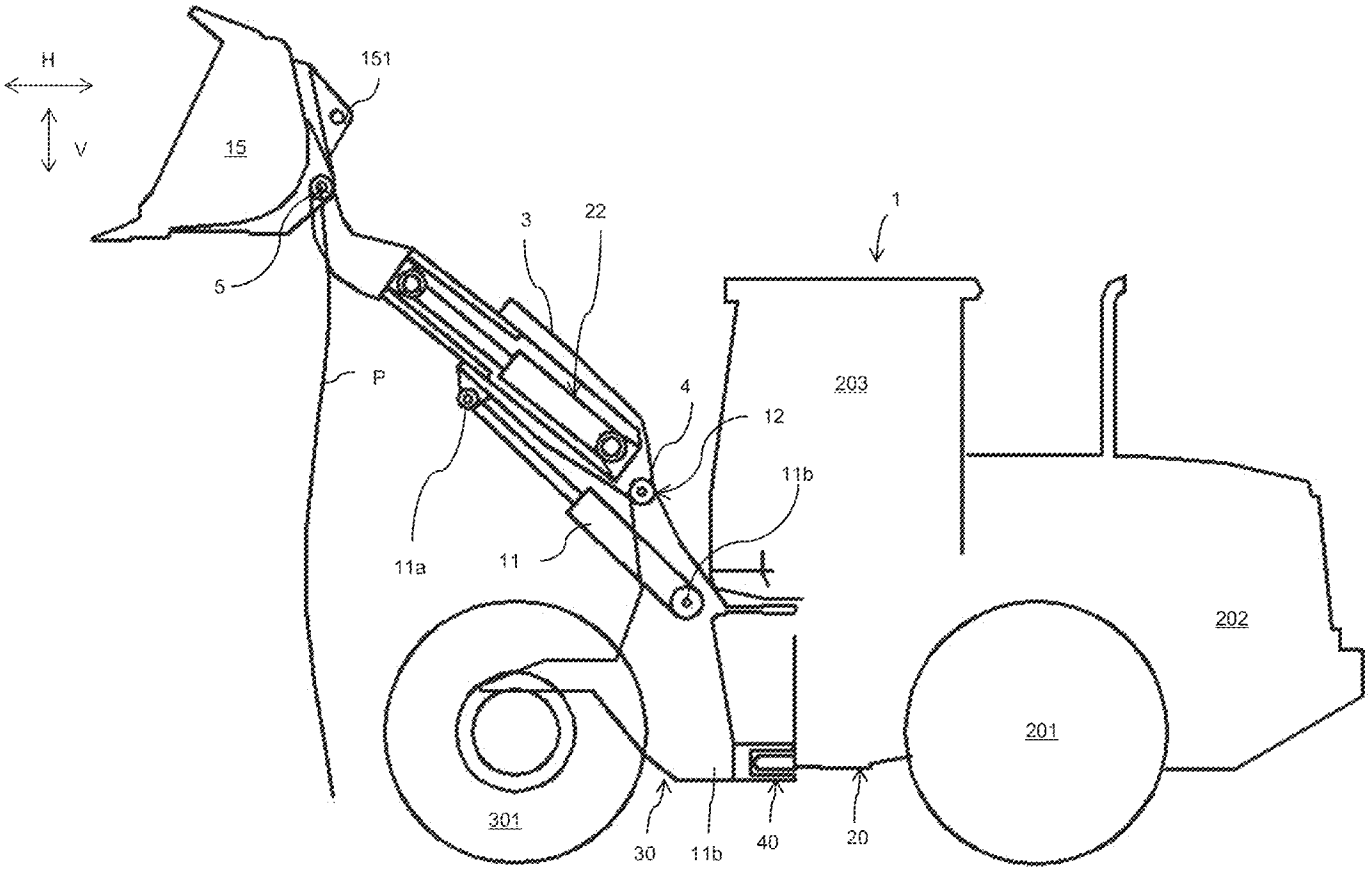

In a modification of the ninth embodiment shown in FIGS. 28-30, the position of the main actuating element 11 is different in that the second end 11*b* of the main arm actuating element 11 is arranged in a vertical higher position at the front frame portion 30, whereas the first end 11*a* of the main arm actuating element 11 is pivotably mounted to the main arm 3 at a position which is further remote from the pivot connector 4 in the previous eighth embodiment. It is noted that such amendments and revisions of the specific attachment positions are possible throughout the above embodiments depending on the specific requirements in order to provide the desired lifting operation. That is, the above disclosed specific positions are not essential to the invention and any revisions or adaptations can be performed as long as the basic concept of the invention can be achieved which is defined in the claims.

It is noted that the first ends of the actuating elements, such as the first end 11*a* and the second end 11*b* of the main arm actuating element 11 as well as the first end 21*a* and the second end 22*b* of the auxiliary actuating element 21 can be reversed as long as the actuating elements achieve an operation of the lifting arrangement based on an extension of retracting action thereof. Also, the arrangement of the ninth embodiment or of the modification thereof can be combined with the arrangements of the remaining embodiments leading to a further improvement of the resulting lifting arrangement.

REFERENCE SIGNS

1 construction machine
3 main arm
4 pivot connector
5 equipment connector
6 main arm support means
6a main arm support link
6b actuation extension
11 main arm actuating element
11a first end
11b second end
12 first bearing portion
13 second bearing portion
15 bucket
16 lifting fork
20 rear frame portion
21, 22 auxiliary actuating element
21a first end
21b second end
30 front frame portion
40 articulating steering arrangement
50 determining means
51, 51A first sensing means
52, 52A second sensing means
60 control means
61 input section
62 output section
63 storage means
201 a pair of rear wheels
202 engine compartment
203 operator's cap
301 a pair of front wheels
P path
T tilting point
H horizontal direction
V vertical direction

The invention claimed is:

1. Lifting arrangement for a construction machine, preferably for a wheel loader (1) having a frame arrangement with a front frame portion (30) and a rear frame portion (20), said lifting arrangement being mountable to said frame arrangement, said lifting arrangement comprising;

a main arm (3) which is provided with a pivot connector (4) at a proximate end thereof and an equipment connector (5) at a distal end thereof, a main arm support means (6) for pivotably supporting said pivot connector (4) of said main arm (3), wherein said main arm support means (6) is movably mounted on said frame arrangement such that said pivot connector (4) of said main arm (3) is movable in a direction which includes at least a component in the front-rear direction with respect to said frame arrangement, a main arm actuating element (11) engaged to said main arm (3), and an auxiliary actuating element (21) engaged to said main arm support means (6) for moving said equipment connector (5) between a lowered position and a lifted position, determining means (50) for determining a lifting related quantity reflecting a position of said equipment connector (5) with respect to said front frame arrangement (30), and control means (60) for controlling an operation of said main arm actuating element (11) and said auxiliary actuating element (21) based on the determined lifting related quantity, such that a path of said equipment connector (5) upon moving said main arm (3) between said lowered position and said lifted position follows a predetermined path, preferably a substantially vertical path.

2. Lifting arrangement for a construction machine according to claim 1, wherein said support means (6) is formed as support link (6*a*) having a first bearing portion (12) and a second bearing portion (13), said first bearing portion (12) being pivotably mounted to said pivot connector (4) of said main arm (3) and said second bearing portion (13) being pivotably mounted to said front frame portion (30).

3. Lifting arrangement for a construction machine according to claim 1, wherein said main arm actuating element (11) has a first end (11*a*) and a second end (11*b*), the first end (11*a*) being pivotably mounted to said main arm (3) at a position between said pivot connector (4) and said equipment connector (5).

4. Lifting arrangement for a construction machine according to claim 1, wherein said auxiliary actuating element (21) has a first end (21*a*) and a second end (21*b*), the first end (21*a*) being pivotably mounted to said main arm support means (6).

5. Lifting arrangement for a construction machine according to claim 4, wherein said second end (21*b*) of said auxiliary actuating element (21) is pivotably mounted to said main arm (3).

6. Lifting arrangement for a construction machine according to claim 4, wherein said second end (21*b*) of said auxiliary actuating element (21) is pivotably mounted to said front frame portion (30).

7. Lifting arrangement for a construction machine according to claim 1, wherein said second end (11*b*) of said main arm actuating means (11) is pivotably mounted to said front frame portion (30).

8. Lifting arrangement for a construction machine according to claim 1, wherein said second end (11*b*) of said main arm actuating means (11) is pivotably mounted to said main arm support means (6).

9. Lifting arrangement for a construction machine according to claim 2, wherein said support link (6*a*) includes an actuation extension (6*b*) which is mounted to said second bearing portion (13) and extends straight or angled with respect to a longitudinal direction of said support link (6*a*), said first end (21*a*) of said auxiliary actuating element (21) being pivotably mounted to said actuating extension (6*b*).

10. Lifting arrangement for a construction machine according to claim 1, wherein said determining means (50) includes a first sensing means (51; 51A) for determining a rotational position of said main arm (3) with respect to said main arm support means (6) and a second sensing means (52; 52A) for determining the position of said main arm support means (6) with respect to said front frame portion (30), said first and second sensing means (51, 52) preferably including at least one of an angle sensor and a linear sensor.

11. Lifting arrangement for a construction machine, preferably for a wheel loader (1) having a frame arrangement with a front frame portion (30) and a rear frame portion (20), said lifting arrangement being mountable to said frame arrangement, said lifting arrangement comprising;

a main arm (3) which is provided with a pivot connector (4) at a proximate end thereof and an equipment connector (5) at a distal end thereof, a main arm support means (6) for pivotably supporting said pivot connector (4) of said main arm (3), a main arm actuating element (11) engaged to said main arm (3) for moving said equipment connector (5) between a lowered position and a lifted position, and an auxiliary actuating element (22) which is mounted to said main arm (3) and engaged to said equipment connector (5) for moving said equipment connector (5) in a direction which includes at least a component in the front-rear direction with respect to said frame arrangement, determining means (50) for determining a lifting related quantity reflecting a position of said equipment connector (5) with respect to said front frame arrangement (30), and control means (60) for controlling an operation of said main arm actuating element (11) and said auxiliary actuating element (22) based on the determined lifting related quantity, such that a path of said equipment connector (5) upon moving said main arm (3) between said lowered position and said lifted position follows a predetermined path, preferably a substantially vertical path.

12. Lifting arrangement for a construction machine according to claim 11, wherein said determining means (50) includes a first sensing means (51; 51A) for determining a rotational position of said main arm (3) with respect to said main arm support means (6) and a second sensing means (52A) for determining the position of said equipment connector (5) with respect to said main arm (3), said first and second sensing means (51; 51A, 52A) preferably including at least one of an angle sensor and a linear sensor.

13. Lifting arrangement for a construction machine according to claim 1, wherein at least one linear sensor is mounted to said main arm actuating element (11) and/or said auxiliary actuating element (21; 22) for determining a respective extension position thereof.

14. Lifting arrangement for a construction machine according to claim 1, wherein said control means (60) is arranged with an input section (61) for receiving at least a signal reflecting a target position of said equipment connector (5) and said lifting related quantity and with an output section (62) for outputting operational signals to said main arm actuating element (11) and said auxiliary actuating element (21; 22).

15. Lifting arrangement for a construction machine according to claim 1, wherein said control means (60) is equipped with a storage means (63) storing a pattern defining a unique relationship between an actuating position of said main arm actuating element (11) and an actuating position of said support means actuating element (21; 22), wherein the control performed by said control means (60) is based on said pattern.

16. Lifting arrangement for a construction machine according to claim 15, wherein said relationship is such that a movement of said equipment connector (5) follows a predetermined path upon lifting said equipment connector (5) between said lowered position and said lifted position.

17. Lifting arrangement for a construction machine according to claim 1, wherein at least one of a bucket (15) and a lifting fork (16) for lifting heavy loads is tiltably mounted to said equipment connector (5).

18. Wheel loader (1) having an articulating frame arrangement consisting of a front frame portion (30) and a rear frame portion (20) which are articulatingly interconnected for providing an articulating steering, comprising a lifting arrangement according to claim 1.

19. Wheel loader (1) according to claim 18, wherein elements forming said lifting arrangement are supported by said front frame portion (30) of said articulating frame arrangement and are articulated together with said front frame portion (30) with respect to said rear frame portion (20) upon steering actions.

* * * * *